US010661287B2

(12) United States Patent
Jackson

(10) Patent No.: US 10,661,287 B2
(45) Date of Patent: May 26, 2020

(54) PASSIVE ELECTROSTATIC CO2 COMPOSITE SPRAY APPLICATOR

(71) Applicant: David P. Jackson, Saugus, CA (US)

(72) Inventor: David P. Jackson, Saugus, CA (US)

( * ) Notice: Subject to any disclaimer, the term of this patent is extended or adjusted under 35 U.S.C. 154(b) by 57 days.

(21) Appl. No.: 15/945,698

(22) Filed: Apr. 4, 2018

(65) Prior Publication Data

US 2018/0280998 A1 Oct. 4, 2018

Related U.S. Application Data

(60) Provisional application No. 62/481,575, filed on Apr. 4, 2017.

(51) Int. Cl.
*B24C 11/00* (2006.01)
*B05B 5/03* (2006.01)
(Continued)

(52) U.S. Cl.
CPC ..... *B05B 5/032* (2013.01); *B05B 5/0255* (2013.01); *B05B 5/1683* (2013.01); *B24C 1/003* (2013.01); *B24C 11/005* (2013.01)

(58) Field of Classification Search
CPC ..... B05B 5/032; B05B 5/0255; B05B 5/1683; B24C 1/003; B24C 11/005
See application file for complete search history.

(56) References Cited

U.S. PATENT DOCUMENTS 2,052,869 A 9/1936 Coanda
2,302,289 A 11/1942 Bramston-Cook
(Continued)

FOREIGN PATENT DOCUMENTS

CA 2579294 A1 * 4/2006 ..... B24C 1/003
DE 19903243 8/2000
WO WO01/74538 10/2001

OTHER PUBLICATIONS

Vicray, R., et. al.; "Thermally Stable Lubricants from Vegetable Oils." Global Plastics Environmental Conference 2004:151-155; see website: http://sperecycling.org/sites/sperecycling.org/files/gpec/GPEC2004/papers/020.pdf.

(Continued)

*Primary Examiner* — Sharidan Carrillo
(74) *Attorney, Agent, or Firm* — Law Office of David Hong

(57) ABSTRACT

An electrostatic spray application apparatus and method for producing an electrostatically charged and homogeneous $CO_2$ composite spray mixture containing an additive and simultaneously projecting at a substrate surface. The spray mixture is formed in the space between $CO_2$ and additive mixing nozzles and a substrate surface. The spray mixture is a composite fluid having a variably-controlled aerial and radial spray density comprising pressure- and temperature-regulated propellant gas (compressed air), $CO_2$ particles, and additive particles. There are two or more circumferential and high velocity air streams containing passively charged $CO_2$ particles which are positioned axis-symmetrically and coaxially about an inner and lower velocity injection air stream containing one or more additives to form a spray cluster. The axis-symmetrical $CO_2$ particle-air streams are passively tribocharged during formation, and the spray clustering arrangement creates a significant electrostatic field and Coanda air mass flow between and surrounding the coaxial flow streams.

5 Claims, 17 Drawing Sheets

(51) Int. Cl.

| | |
|---|---|
| ***B05B 5/16*** | (2006.01) |
| ***B05B 5/025*** | (2006.01) |
| ***B24C 1/00*** | (2006.01) |

(56) References Cited

U.S. PATENT DOCUMENTS

| | | | | |
|---|---|---|---|---|
| 2,894,691 | A | 7/1959 | Sedlacsik | |
| 3,047,208 | A | 7/1962 | Coanda | |
| 3,117,726 | A | 1/1964 | Schoberg | |
| 3,628,737 | A | 12/1971 | Norton | |
| 3,648,401 | A | 3/1972 | Stains | |
| 3,670,606 | A | 6/1972 | Blomgren | |
| 3,672,181 | A | 6/1972 | Tyree | |
| 3,702,519 | A | 11/1972 | Rice | |
| 3,708,993 | A | 1/1973 | Hardt | |
| 3,734,412 | A | 5/1973 | Haas | |
| 3,743,186 | A | 7/1973 | Mocarski | |
| 3,747,284 | A | 7/1973 | Lyzeko | |
| 3,795,367 | A | 3/1974 | Mocarski | |
| 3,801,020 | A | 4/1974 | Mocarski | |
| 3,806,039 | A | 4/1974 | Mocarski | |
| 3,862,391 | A | 1/1975 | Blomgren | |
| 3,917,114 | A | 11/1975 | Grosse | |
| 3,984,054 | A | 10/1976 | Frochaux | |
| 3,985,302 | A | 10/1976 | Frochaux | |
| 3,990,332 | A | 11/1976 | Flom | |
| 4,022,119 | A | 5/1977 | Karr | |
| 4,038,786 | A | 8/1977 | Fong | |
| 4,046,492 | A | 9/1977 | Inglis | |
| 4,073,966 | A | 2/1978 | Scholes | |
| 4,195,780 | A | 4/1980 | Inglis | |
| 4,336,017 | A | 6/1982 | Desty | |
| 4,341,347 | A | 7/1982 | DeVittorio | |
| 4,385,728 | A | 5/1983 | Inglis | |
| 4,389,820 | A | 6/1983 | Fong | |
| 4,555,059 | A | 11/1985 | Collins | |
| 4,703,590 | A | 11/1987 | Westergaard | |
| 4,707,951 | A | 11/1987 | Gibot | |
| 4,749,125 | A | 6/1988 | Escallon | |
| 4,776,515 | A | 10/1988 | Michalchik | |
| 4,801,086 | A | 1/1989 | Noakes | |
| 4,806,171 | A | 2/1989 | Whitlock | |
| 4,829,859 | A | 5/1989 | Yankoff | |
| 5,002,156 | A | 3/1991 | Gaunt | |
| 5,056,720 | A | 10/1991 | Crum | |
| 5,124,132 | A | 6/1992 | Francis | |
| 5,125,979 | A | 6/1992 | Swain | |
| 5,170,942 | A | 12/1992 | Spink | |
| 5,222,332 | A | 6/1993 | Mains | |
| 5,231,851 | A | 8/1993 | Adolfsson | |
| 5,312,598 | A | 5/1994 | Kersey | |
| 5,315,793 | A | 5/1994 | Peterson | |
| 5,333,640 | A | 8/1994 | Swift | |
| 5,402,940 | A | 4/1995 | Haller | |
| 5,409,418 | A | 4/1995 | Krone-Schmidt | |
| 5,444,634 | A | 8/1995 | Goldman | |
| 5,509,335 | A | 4/1996 | Emerson | |
| 5,591,412 | A | 1/1997 | Jones | |
| 5,592,863 | A | 1/1997 | Jaskowiak | |
| 5,611,491 | A | 3/1997 | Bowers | |
| 5,704,554 | A | 1/1998 | Cooper | |
| 5,725,154 | A | 3/1998 | Jackson | |
| 5,765,761 | A | 6/1998 | Law | |
| 5,853,128 | A | 12/1998 | Bowen | |
| 5,901,623 | A | 5/1999 | Hong | |
| 5,918,817 | A | 7/1999 | Kanno | |
| 6,039,269 | A | 3/2000 | Mandzukic | |
| 6,056,213 | A | 5/2000 | Ruta | |
| 6,105,886 | A | 8/2000 | Hollstein | |
| 6,125,787 | A | 10/2000 | Mochizuki | |
| 6,206,764 | B1 | 3/2001 | Hsu | |
| 6,564,682 | B1 | 5/2003 | Zurecki | |
| 6,656,017 | B2 | 12/2003 | Jackson | |
| 6,708,903 | B2 | 3/2004 | Kanno | |
| 6,802,961 | B2 | 10/2004 | Jackson | |
| 6,979,362 | B2 | 12/2005 | Jackson | |
| 7,097,717 | B2 | 8/2006 | Jung | |
| 7,134,946 | B1 | 11/2006 | Jackson | |
| 7,198,043 | B1 | 4/2007 | Zhang | |
| 7,219,677 | B1 | 5/2007 | Jackson | |
| 7,225,819 | B2 | 6/2007 | Jackson | |
| 7,293,570 | B2 | 11/2007 | Jackson | |
| 7,387,477 | B2 | 6/2008 | Usuki | |
| 7,389,941 | B2 | 6/2008 | Jackson | |
| 7,451,941 | B2 | 11/2008 | Jackson | |
| 7,601,112 | B2 | 10/2009 | Jackson | |
| 7,901,540 | B2 | 3/2011 | Jackson | |
| 8,021,489 | B2 | 9/2011 | Jackson | |
| 8,048,830 | B1 | 11/2011 | Jackson | |
| 8,197,603 | B2 | 6/2012 | Jackson | |
| 8,801,504 | B2 * | 8/2014 | Bowers | B24C 1/003 451/102 |
| 9,221,067 | B2 | 12/2015 | Jackson | |
| 9,227,215 | B2 | 1/2016 | Jackson | |
| 9,352,355 | B1 | 5/2016 | Jackson | |
| 9,387,511 | B1 | 7/2016 | Jackson | |
| 2002/0020691 | A1 | 2/2002 | Jewett | |
| 2003/0207655 | A1 | 11/2003 | Jackson | |
| 2004/0003828 | A1 | 1/2004 | Jackson | |
| 2004/0251327 | A1 | 12/2004 | Messerly | |
| 2006/0027679 | A1 * | 2/2006 | Gratteau | F02K 1/40 239/291 |
| 2006/0071091 | A1 | 4/2006 | Ratnik | |
| 2006/0278254 | A1 | 12/2006 | Jackson | |
| 2007/0164130 | A1 * | 7/2007 | Jackson | B05B 5/03 239/419.5 |
| 2007/0246064 | A1 | 10/2007 | Jackson | |
| 2009/0136086 | A1 | 5/2009 | Farina | |
| 2011/0233456 | A1 | 9/2011 | Jackson | |
| 2018/0280998 | A1 * | 10/2018 | Jackson | B24C 11/005 |

OTHER PUBLICATIONS

U.S. Appl. No. 62/481,575, filed Apr. 4, 2017 for "Passive Electrostatic CO2 Composite Spray Applicator"; Jackson, et. al.

PCT/US2018/26143, filed on Apr. 4, 2018 for "Passive Electrostatic CO2 Composite Spray Applicator"; Jackson, et. al.

U.S. Appl. No. 62/266,539, (filed Dec. 11, 2015) for Adaptive R744 Min. Quantity Cooling Lubrication System; Jackson, et. al.

U.S. Appl. No. 11/301,441, (filed Dec. 13, 2005) for "Device for applying cryogenic composition and method of using same." Jackson, D.

U.S. Appl. No. 11/301,466, (filed Dec. 13, 2005) for "Cryogenic fluid composition." Jackson, D.

PCT/US2005/045122; Jackson, D. "Device for applying cryogenic composition and method of using same." filed Dec. 13, 2005.

PCT/US2005/044863; Jackson, D., "Carbon dioxide snow apparatus." filed Dec. 13, 2005.

PCT/US2005/045180; Jackson, D. "Cryogenic fluid composition." filed Dec. 13, 2005.

U.S. Appl. No. 11/766,762, (filed Jun. 21, 2007) for Method of Treatment a Substrate; first inventor: Jackson.

U.S. Appl. No. 11/425,087, (filed Jun. 19,2006) for Method for Selectively Treating a Substrate Surface; first Inventor: Jackson.

U.S. Appl. No. 10/362,598, (filed Jun. 13, 2003) for Surface Cleaning and Modification Processes, Methods and Apparatus Using Physicochemically; first inventor: Jackson.

U.S. Appl. No. 10/393,872 (Mar. 21, 2003) for Precision Surface Treatment Using Dense Fluids and a Plasma; first inventor: Jackson.

U.S. Appl. No. 13/733,880 (Jan. 3, 2013); 61/583,186 (Jan. 5, 2012) for Method for forming and applying an oxgenated machining fluid; first inventor: Jackson.

U.S. Appl. No. 61/843,730, (filed Jul. 8, 2013) for Method for Treating a Substrate Surface using Ozonated Solvent and Ultraviolet Light; first inventor: Jackson.

U.S. Appl. No. 61/843,751, (filed Jul. 8, 2013) for Method and Apparatus for Cutting and Cleaning a Superhard Substrate; first inventor: Jackson.

U.S. Appl. No. 61/583,186, (filed Jan. 5, 2012) for Method for Forming and Applying an Oxygenated Machining Fluid; first inventor: Jackson.

(56) References Cited

OTHER PUBLICATIONS

U.S. Appl. No. 61/583,190, (filed Jan. 5, 2012) for Method and Apparatus for Cutting and Cleaning a Superhard Substrate; first inventor: Jackson.
U.S. Appl. No. 10/362,598, (filed Jun. 13, 2003) for Surface Cleaning and Modification Processes . . . ; first inventor: Jackson.
U.S. Appl. No. 11/465,762, (filed Aug. 18, 2006) for Dense Fluid Delivery Apparatus; first inventor: Jackson.
U.S. Appl. No. 11/271,725, (filed Nov. 9, 2005) for Dense Fluid Cleaning . . . ; first inventor: Jackson.
U.S. Appl. No. 13/423,603, (filed Mar. 19, 2012); 61/454,026, (filed Mar. 18, 2011) for Method and Apparatus for Thermal Control within a Machining Process; first inventor: Jackson.
U.S. Appl. No. 11/465,775, (filed Aug. 18, 2006) for Method and apparatus for treating a substrate with Dense Fluid and Plasma; first inventor: Jackson.
U.S. Appl. No. 10/433,833, (filed Jun. 9, 2003) for Apparatus, Process and Method for Mounting and Treating a Substrate; first inventor: Jackson.
U.S. Appl. No. 10/343,734, (filed Jan. 1, 2003) for Method and Apparatus for Supercritical Ozone treatment of a substrate; first inventor: Jackson.
U.S. Appl. No. 60/635,399, (filed Dec. 13, 2004) for Method, process, chemistry and apparatus for selective thermal control, lubrication and post-cleaning a substrate; first inventor: Jackson.
U.S. Appl. No. 60/635,230, (filed Dec. 13, 2004) for Method and app. for selectively treating a substrate using cryogenic sprays; first inventor: Jackson.
U.S. Appl. No. 10/221,593, (filed Sep. 12, 2002) for dense fluid spray cleaning process and apparatus; first inventor: Jackson.
U.S. Appl. No. 08/516,530, (filed Aug. 18, 1995) for dense fluid spray cleaning process and apparatus; first inventor: Jackson.
U.S. Appl. No. 10/221,767, (filed Mar. 13, 2001) for dense fluid cleaning centrifugal phase shirting separation process and apparatus; first inventor: Jackson.
U.S. Appl. No. 10/476,108, (filed Oct. 24, 2003) for apparatus and process for the treatment, delivery and recycle of process fluids . . . ; first inventor: Jackson.
U.S. Appl. No. 13/016,836, (filed Jan. 28, 2011) for substrate treatment process; first inventor: Jackson.
U.S. Appl. No. 10/428,793, (filed May 2, 2003) for Method and Apparatus for Selective Treatment of a Precision Substrate Surface; first inventor: Jackson.
U.S. Appl. No. 10/393,872, (filed Mar. 21, 2003) for Precision Surface Treats Using Dense Fluids and a Plasma; first inventor: Jackson.
U.S. Appl. No. 13/863,311, filed Apr. 14, 2013 for Particle-Plasma Ablation Process; inventors: Jackson and Endres.
U.S. Appl. No. 61/820,524, (filed May 7, 2013) for Photomechanical Machining Method for a Dielectric Cutting System; first inventor: Jackson.
U.S. Appl. No. 61/836,636 for Det. of Composition and Structure of a CO2 Composite Spray; first inventor: Jackson.
U.S. Appl. No. 61/836,635 for CO2 Composite Spray Method and Apparatus; first inventor: Jackson.
U.S. Appl. No. 61/624,322, (filed Apr. 15, 2012); U.S. Appl. No. 13/863,311, (filed Apr. 15, 2013) for Particle-Plasma Abelation Process; Inventors: Jackson and Endres.
U.S. Appl. No. 13/863,318, (filed Apr. 15, 2013) for Particle-Plasma Abelation Process; Inventors: Jackson and Endres.
U.S. Appl. No. 14/307,488, (filed Jun. 17, 2014); U.S. Appl. No. 61/836,635, (filed Jun. 18, 2013); U.S. Appl. No. 61/836,636, (filed Jun. 18, 2013) for CO2 Composite Spray Method and Apparatus; Inventors: Jackson, et. al.
U.S. Appl. No. 14/308,697, (filed Jun. 18, 2014); U.S. Appl. No. 61/836,635, (filed Jun. 18, 2013); U.S. Appl. No. 61/836,636, (filed Jun. 18, 2013) for Det. of Composition and Structure of CO2 Composite Spray; Inventors: Jackson, et. al.
PCT/US2014/043046, filed on Jun. 18, 2014 for Method and Apparatus for Forming and Regulating a CO2 Composite Spray; Inventor Jackson, et. al.
U.S. Appl. No. 14/325,278, (filed Jul. 7, 2014) for Method for Treating a Substrate Surface Using Ozonated Solvent and Ultraviolet Light; Inventor: Jackson; U.S. Appl. No. 61/843,730, filed Jul. 8, 2013.
U.S. Appl. No. 14/335,875, (filed Jul. 18, 2014) for Method and Appraatus for Cutting and Cleaning a Superhard Substrate; Inventor: Jackson.
U.S. Appl. No. 16/217,040 for Adaptive R744 Min. Quantity Cooling Lubrication System, on Dec. 11, 2018; claims benefit of U.S. Appl. No. 62/597,526, filed Dec. 12, 2017.
PCT/US2018/065053, filed on Dec. 11, 2018; first listed inventor: Jackson.
Aronson, R.,"Using High-Pressure Fluids", Manufacturing Engineering, Jun. 2004, vol. 132, No. 6; http://www.sme.org/MEMagazine/Article.aspx?id=37402&taxid=1416.
Kubie, L., "The Solubility of O2, CO2, and N2 in Mineral Oil and the Transfer of Carbon Dioxide from Oil to Air," Jan. 1927.
Hobbie, M., "Disintegration of Liquid Phases in Pressurized Gases—Influence of Mass Transfer", ILASS Europe 2002, Zaragoza 9, Sep. 11, 2002.
Rainey, K.N.,"Effect of Pressure, Subcooling, and Dissolved Gas on Pool Boiling Heat Transfer From Microporous Surfaces in FC-72", Int'l Journal of Heat and Mass Transfer, Jan. 2003, vol. 46(1): 23-35.
Schey, J., Tribology in Metalworking—Friction, Lubrication and Wear, American Society for Metals, 1983, pp. 624-625.
Veillette, M., Abstract for "Six Month Tracking of Microbial Growth in a Metalworking Fluid after System Cleaning and Recharging", M. Veillette et al., Am. Occup. Hyg., vol. 48, No. 6, pp. 541-546, 2004.
"U.S. Food and Drug Administration, Kinetics of Microbial Inactivation for Alternative Food Processing Technologies—High Pressure Processing", U.S. Food and Drug Administration, Center for Food Safety and Applied Nutrition, Jun. 2, 2000.
Hendershot, R., "Use of Oxygen to Improve Combustion and Oxidation", Hendershot, R et al, Chemical Engineering Progress, Jul. 2010.
Fox, G., Self-Organization During Friction—Advanced Surface-Engineered Materials and Systems Design, German S. Fox-Rabinovich et al, CRC Taylor and Francis Group, 2007.
Buckley, D., "The Role of the Micro Environment on the Tribological Behavior of Materials", Buckley, D., NASA Technical Memorandum 81434, NASA-TM-81434, NASA Lewis Research Center, Cleveland, Ohio, 1980.
Rakovsky, S., "Fields of Ozone Applications", Rakovsky, S et al, Chemistry and Chemical Technology, vol. 3, No. 2, 2009.
Nguyen, T., "An Assessment of the Applicability of Cold Air and Oil Mist in Surface Grinding", Nguyen, T. et al, Journal of Materials Processing Technology, 140 (2003), pp. 224-230.
Han, R., Abstract for "Experimental Investigation of the Effect of Ozone in Green Cutting", Han R. et al, Key Engineering Materials, vols. 431-432 2010) pp. 217-220.

* cited by examiner

Present Invention 140
248
250
252

252
250
254
140

140
256
258
260

PASSIVE ELECTROSTATIC CO2 COMPOSITE SPRAY APPLICATOR

PRIORITY CLAIM

This application claims the benefit of U.S. Provisional Patent Application No. 62/481,575, filed on Apr. 4, 2017, which is incorporated by reference in entirety.

BACKGROUND OF INVENTION

The present invention generally relates to spray applicators for forming and projecting a $CO_2$ Composite Spray (a trademark of CleanLogix LLC). More specifically, the present invention relates to a passive electrostatic spray nozzle and spray applicator assembly employing air, solid carbon dioxide, and additive particles such as organic solvents, coatings, paints, nanoparticles, microabrasives, and lubricants.

Use of $CO_2$ composite sprays for cleaning, cooling and/or lubrication is widely known in the art. For example, $CO_2$ composite sprays are typically employed during hard machining processes requiring cleaning, selective thermal control, and/or lubrication during turning, precision abrasive grinding, or dicing operations. In these applications, $CO_2$ composite sprays are employed to extend cutting tool or abrasive wheel life, and to improve productivity, dimensional tolerance, and surface finish.

There exist in the art several examples of $CO_2$ spray applicators which are employed to direct a $CO_2$ spray onto substrates, work pieces, and the like, in manufacturing or industrial processes. Such examples include U.S. Pat. Nos. 4,389,820, 4,806,171 and 5,725,154. Each of the aforementioned, however, have shortcomings in the application of sprays for cleaning, cooling and lubricating purposes, more especially the formation and application of $CO_2$ composite sprays beneficial for cooling and lubricating purposes.

For example, efficient and effective application of $CO_2$ composite sprays to machined substrates presents several challenges. When sufficiently high spray velocities are employed to provide enough energy to reach cutting zone surfaces, the majority of the spray tends to deflect from or stream around the cutting zone surfaces rather than impinge upon them. When low velocity sprays are employed, critical surfaces with recesses or complex surfaces cannot be penetrated effectively. For example, during application of $CO_2$-based cooling-lubricating sprays it is observed that oil additive agglomerates into very large precipitations during transition from spray nozzles to surfaces. This phenomenon interferes with the even distribution of both $CO_2$ coolant particles and oil-based lubricant on machined surfaces and causes a large portion of the atomized spray to miss the substrate entirely if positioned at a location too far away from the substrate being machined, wasting a portion of the applied spray. This phenomenon occurs because the lubricating additive, such as an oil, and a cooling component, solid carbon dioxide particles, have certain physicochemical properties which are in complete opposition—namely high melt point and extremely low temperature, respectively. The temperature of the $CO_2$ particles (i.e., coolant) cause a flowing lubricant additive to solidify or gel prematurely before a uniform particle size and spray distribution can be established within the spray. This phenomenon inhibits uniform and homogenous dispersions. This is particularly the case when the mixing between the $CO_2$ solid particles and additive particles occurs within the nozzle or near the nozzle tip, resulting in inconsistent spray patterns and chemistry, and the nozzle becoming clogged with frozen and agglomerated oil and additives.

The prior art contains several examples of $CO_2$ spray application techniques for incorporating beneficial additives into a $CO_2$ composite spray. Examples include the addition of organic solvent additives to enhance spray cleaning performance, lubricant additives to enhance machining performance, and plasma additives to enhance surface modification for adhesive bonding. Examples of prior art in this regard include U.S. Pat. Nos. 5,409,418, 7,451,941, 7,389,941 and 9,352,355. In each of the aforementioned examples, an additive fluid comprising ions, solvent, oil, or a plasma, respectively, is added directly into a centrally disposed $CO_2$ particle spray using an injection means that is integrated with the $CO_2$ spray nozzle device, and in some cases include a means for actively charging the additive particles using high voltage and an electrode to enhance additive particle attraction, mixing and atomization. However, as already noted this type of injection scheme introduces constraints for spray additives which are inherently incompatible with the physicochemistry of the $CO_2$ spray at or near the spray forming nozzle. For example, high spray pressure and velocity, very low temperature, and passive electrostatic charging within the $CO_2$ particle nozzle body and exit introduce flow and mixing constraints for high melt point oils. High molecular weight natural oils such as soybean and canola oil provide the most superior lubrication qualities for machining applications but will gel or solidify at temperatures much higher than those present within or near the $CO_2$ particle nozzle exit. Exacerbating this problem is electrostatic fields and charges present during the formation and ejection of $CO_2$ particles within and from the nozzle. Spray charging using a high voltage electrode or passively charging (tribocharging) the additive and/or $CO_2$ particles, respectively, electrostatically charges and coalesces the subcooled high melting point oil films into large and sticky gels or masses near or within the nozzle tip which inhibits flow and injection into the $CO_2$ particle stream. Moreover, these larger additive particle masses once injected into the cold $CO_2$ particle stream and projected at a target surface inhibit gap penetration during to very low surface area, for example within a cutting zone comprising cutting tool, workpiece and chip crevice. The result is a spray with compositional variance over time—large particle masses with low surface area or a complete lack of lubricating particles. Moreover, the additive injection apparatus and methods of the prior art require an individual additive injection scheme for each $CO_2$ spray nozzle necessitating more complicated multi-spray configuration schemes in applications requiring larger aerial and radials spray densities for increased application productivity or utility.

BRIEF SUMMARY OF INVENTION

An apparatus for producing an electrostatically charged and homogeneous CO2 composite spray containing an additive for use on a substrate surface comprising: multiple nozzle electrodes can be positioned axis symmetrically about an additive injection nozzle; said nozzle electrodes can comprise an elongated body with a nozzle tip with a center through hole, and arising from the center through hole, there can be multiple or at least three axisymmetric through ports; the multiple or at least three through ports can form three landing guides 221 or support portions for centering and positioning an adjustable expansion tube assembly; the adjustable expansion tube assembly can comprise a first capillary within a second capillary; the first and the second capillaries can be adjustable within the center through hole; the additive injection nozzle can comprise a through ported and grounded additive injection nozzle body containing an additive delivery tube, and the grounded additive injection nozzle body can flow air to form an air-additive aerosol; whereby CO2 particles are flowed through the adjustable expansion tube assembly to create an electrostatic charge, which is shunted to the three landing guides 221 or support portions to electrostatically charge the nozzle electrodes, and the CO2 particles then mix with air to form air-CO2 aerosol; the electrostatically charged nozzle electrodes and the air-CO2 aerosol can passively charge the air-additive aerosol; the air-additive aerosol and the air-CO2 aerosol combine away from the nozzles to form the electrostatically charged air-additive-CO2 aerosol, which is projected at the substrate surface, whereby the CO2 particles and the additive interact to form the electrostatically charged and homogeneous CO2 composite spray containing an additive mixture in the space between the nozzles and the substrate surface; and the electrostatically charged and homogeneous CO2 composite spray containing an additive can be projected at the substrate surface; the least two nozzle electrodes can be arranged axis symmetrically about the additive injection nozzle; the additive can comprise flowable organic and inorganic liquids and solids; the substrate surface can be a cutting zone; the additive is a machining lubricant.

An apparatus for producing an electrostatically charged and homogeneous CO2 composite spray containing an additive for use on a substrate surface comprising: multiple nozzle electrodes positioned axis symmetrically about an additive injection nozzle; said nozzle electrodes comprising an elongated body with a nozzle tip with a center through hole, and arising from the center through hole are multiple axisymmetric through ports; near or proximate to said multiple through ports are landing guides for centering and positioning an adjustable expansion tube assembly; the adjustable expansion tube assembly comprises a first capillary within a second capillary; the first and the second capillaries are adjustable within the center through hole; the additive injection nozzle comprising a through ported and grounded additive injection nozzle body containing an additive delivery tube, and the grounded additive injection nozzle body flows air to form an air-additive aerosol; whereby CO2 particles are flowed through the adjustable expansion tube assembly to create an electrostatic charge, which is shunted to the landing guides to electrostatically charge the nozzle electrodes, and the CO2 particles then mix with air to form air-CO2 aerosol; the electrostatically charged nozzle electrodes and the air-CO2 aerosol passively charge the air-additive aerosol; the air-additive aerosol and the air-CO2 aerosol combine away from the nozzles to form the electrostatically charged air-additive-CO2 aerosol, which is projected at the substrate surface, whereby the CO2 particles and the additive interact to form the electrostatically charged and homogeneous CO2 composite spray containing an additive mixture in the space between the nozzles and the substrate surface; and the electrostatically charged and homogeneous CO2 composite spray containing an additive is projected at the substrate surface. Arising from the center through hole, there can be multiple or at least three axisymmetric through ports; and said multiple or at least three through ports form three landing guides for centering and positioning an adjustable expansion tube assembly; at least two nozzle electrodes are arranged axis symmetrically about the additive injection nozzle; the additive comprises flowable organic and inorganic liquids and solids; the substrate surface is a cutting zone; and the additive is a machining lubricant.

A nozzle electrode apparatus for producing an electrostatic field comprising: an elongated body with a nozzle tip with a center through hole, and arising from the center through hole are at least three axisymmetric through ports; said at least three through ports forming three landing guides for positioning an adjustable expansion tube assembly; the adjustable expansion tube assembly comprises a first capillary within a second capillary; the first and the second capillaries are adjustable in position within the through ported center hole; and whereby CO2 particles are flowed through the adjustable expansion tube assembly to create an electrostatic charge, which is shunted to the three landing guides to electrostatically charge the nozzle electrode; the apparatus can be constructed of semi-conductive material or metal; can be between 0.5 and 6.0 inches in length; and can be shunted to earth ground.

A method for treating a surface using an apparatus for producing an electrostatically charged and homogeneous CO2 composite spray containing an additive for use on a substrate surface comprising: multiple nozzle electrodes positioned axis symmetrically about an additive injection nozzle; said nozzle electrodes comprising an elongated body with a nozzle tip with a center through hole, and arising from the center through hole are multiple axisymmetric through ports; proximate to said multiple through ports are landing guides for centering and positioning an adjustable expansion tube assembly; the adjustable expansion tube assembly comprises a first capillary within a second capillary; the first and the second capillaries are adjustable within the center through hole; the additive injection nozzle comprising a through ported and grounded additive injection nozzle body containing an additive delivery tube, and the grounded additive injection nozzle body flows air to form an air-additive aerosol; whereby CO2 particles are flowed through the adjustable expansion tube assembly to create an electrostatic charge, which is shunted to the landing guides to electrostatically charge the nozzle electrodes, and the CO2 particles then mix with air to form air-CO2 aerosol; the electrostatically charged nozzle electrodes and the air-CO2 aerosol passively charge the air-additive aerosol; the air-additive aerosol and the air-CO2 aerosol combine away from the nozzles to form the electrostatically charged air-additive-CO2 aerosol, which is projected at the substrate surface, whereby the CO2 particles and the additive interact to form the electrostatically charged and homogeneous CO2 composite spray containing an additive mixture in the space between the nozzles and the substrate surface; and the electrostatically charged and homogeneous CO2 composite spray containing an additive is projected at the substrate surface, comprising the steps: positioning the apparatus at a first position away from the substrate surface; coating the substrate surface with the electrostatically charged and homogeneous CO2 composite spray containing the additive; stopping the coating of the substrate service with the electrostatically charged and homogeneous CO2 composite spray containing the additive; positioning the apparatus to a second position; and removing the additive from substrate surface by applying the electrostatically charged and homogeneous CO2 composite spray without the additive. This method also has the first position is between 6 and 18 inches from the substrate surface; a soak period of between 1 and 600 seconds follows the application of the electrostatically charged and homogeneous CO2 composite spray containing the additive at the first position; the second position is between 0.5 and 6 inches from the substrate surface; the additive comprises flowable organic and inorganic liquids and solids; the substrate surface is a manufactured surface.

The present aspect provides an apparatus for producing an electrostatically charged and homogeneous $CO_2$ composite spray containing an additive. The present invention overcomes the additive mixing and spray projection constraints of the prior art by positioning an additive injection and atomization nozzle into the center of and coaxial with two or more axis-symmetrically positioned and passively charged $CO_2$ composite spray nozzles. The novel cluster spray arrangement with electrostatic field and velocity driven gradients for mixing additive and $CO_2$ particles, and induced airflow to assist composite spray propulsion and delivery enables the formation of virtually any variety of $CO_2$ composite fluid spray compositions. Uniquely, a multi-component $CO_2$ composite fluid spray of the present invention is formed in space during transit to a target substrate, separated from the $CO_2$ and additive particle injection means, to eliminate interferences introduced by phase change and direct contact charging phenomenon. Axis-symmetrically clustered $CO_2$ sprays surrounding a centrally positioned additive spray flow creates adjustable and uniform electrostatic field and velocity gradients.

The present invention eliminates constraints imposed by the various physicochemical differences between additive spray chemistry and $CO_2$ spray chemistry. Any variety of fluid-entrained or flowable microscopic solids, light and viscous liquids, volatile and condensable gases, ionic, aqueous and non-aqueous liquids, and blends of same may be used. Moreover, discrete additives or blends of high boiling liquids, high melt point compounds, nanoparticles, ionic compounds, ionized fluids, ozonized fluids, dispersions, or suspensions may be used. Still moreover, the usefulness of a $CO_2$ composite spray is extended with the present invention. For example the present invention may be used to apply beneficial surface coatings such as rust prevention agents, primers, and paints immediately following $CO_2$ composite spray cleaning operations.

Another aspect of the present invention is to provide an apparatus and method for providing higher aerial and radial spray densities for a $CO_2$ composite spray to improve spray process productivity. Advantages of $CO_2$ composite sprays as compared to conventional $CO_2$ snow sprays is the ability to adjust $CO_2$ particle-in-propellant gas concentration, spray pressure, and spray mixture temperature. However, a limitation is low aerial and radial spray densities—spray area—for a $CO_2$ spray applicator. This limits productivity in many industrial applications and the current technique used to overcome this limitation is to employ multi-ported wide-spray nozzle arrays. However as already discussed, conventional means for adding beneficial additives makes this type of arrangement very complicated and incompatible with high melt point additive chemistries.

Another aspect of the present invention is to provide a novel electrical discharge machined (EDM) $CO_2$ composite spray mixing nozzle apparatus that is used to selectively position an adjustable $CO_2$ particle injection assembly (i.e., U.S. Pat. No. 9,221,057, FIG. 4B (502)) into a centermost region of a supersonic flow of propellant gas while simultaneously shunting electrostatic charge from the surfaces of the adjustable $CO_2$ particle injection assembly to create an electrostatically charged spray nozzle.

In still another aspect of the present invention, a surface pretreatment coating operation is followed by a precision cleaning operation. In certain cleaning applications surface contamination can be very difficult to remove using a $CO_2$ composite spray alone. The present invention teaches an exemplary pretreatment process for applying a uniform coat of (preferably) high boiling pretreat agents which first solubilize (or otherwise denature) the complex surface contaminant prior to or simultaneously during spray cleaning with a $CO_2$ composite spray.

Finally, the present invention is useful for forming hybrid $CO_2$ composite sprays using virtually any additive chemistry that intensifies a particular spray application such as precision cleaning, hard machining, precision abrasive grinding, adhesive bonding, or surface disinfection. The novel $CO_2$ composite spray applicator of the present invention has been developed to work most efficiently with $CO_2$ composite spray generation systems developed by the first named inventor. Preferred $CO_2$ composite spray generation systems for employing the present invention include U.S. Pat. Nos. 5,725,154, 7,451,941, and 9,221,067, and by reference to same are incorporated into the present invention in their entirety. The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

DETAILED DESCRIPTION

The present invention is an electrostatic spray application apparatus and method for producing an electrostatically charged and homogeneous $CO_2$ composite spray mixture containing an additive and simultaneously projecting at a substrate surface. The $CO_2$ composite spray mixture is formed in the space between $CO_2$ and additive mixing nozzles and a substrate surface. The $CO_2$ composite spray mixture is a composite fluid having a variably-controlled aerial and radial spray density comprising pressure- and temperature-regulated propellant gas (i.e., compressed air), $CO_2$ particles, and additive particles. The invention comprises two or more circumferential and high velocity air streams containing passively charged $CO_2$ particles which are positioned axis-symmetrically and coaxially about an inner and lower velocity injection air stream containing one or more additives to form a spray cluster. One or more spray clusters may be used to form a larger spray cluster configuration. The axis-symmetrical $CO_2$ particle-air streams are passively tribocharged during formation and the spray clustering arrangement creates a significant electrostatic field and Coanda air mass flow between and surrounding the coaxial flow streams. Within the spray cluster, the centrally-positioned additive-air stream exerts a small viscous drag and behaves as an anode relative to the circumferential $CO_2$ particle-air streams behaving as cathodes which causes the charged $CO_2$ particle-air stream and additive-air stream particles to coalesce in space under the influence of the polarized electrostatic field created within the space between them to form a uniform and hybrid air-$CO_2$-additive particle spray stream. Using the present invention, any variety of hybrid air-$CO_2$-additive particle spray streams may be created for industrial manufacturing applications such as coating, cleaning, disinfecting, and cooling-lubrication.

Figure 1:
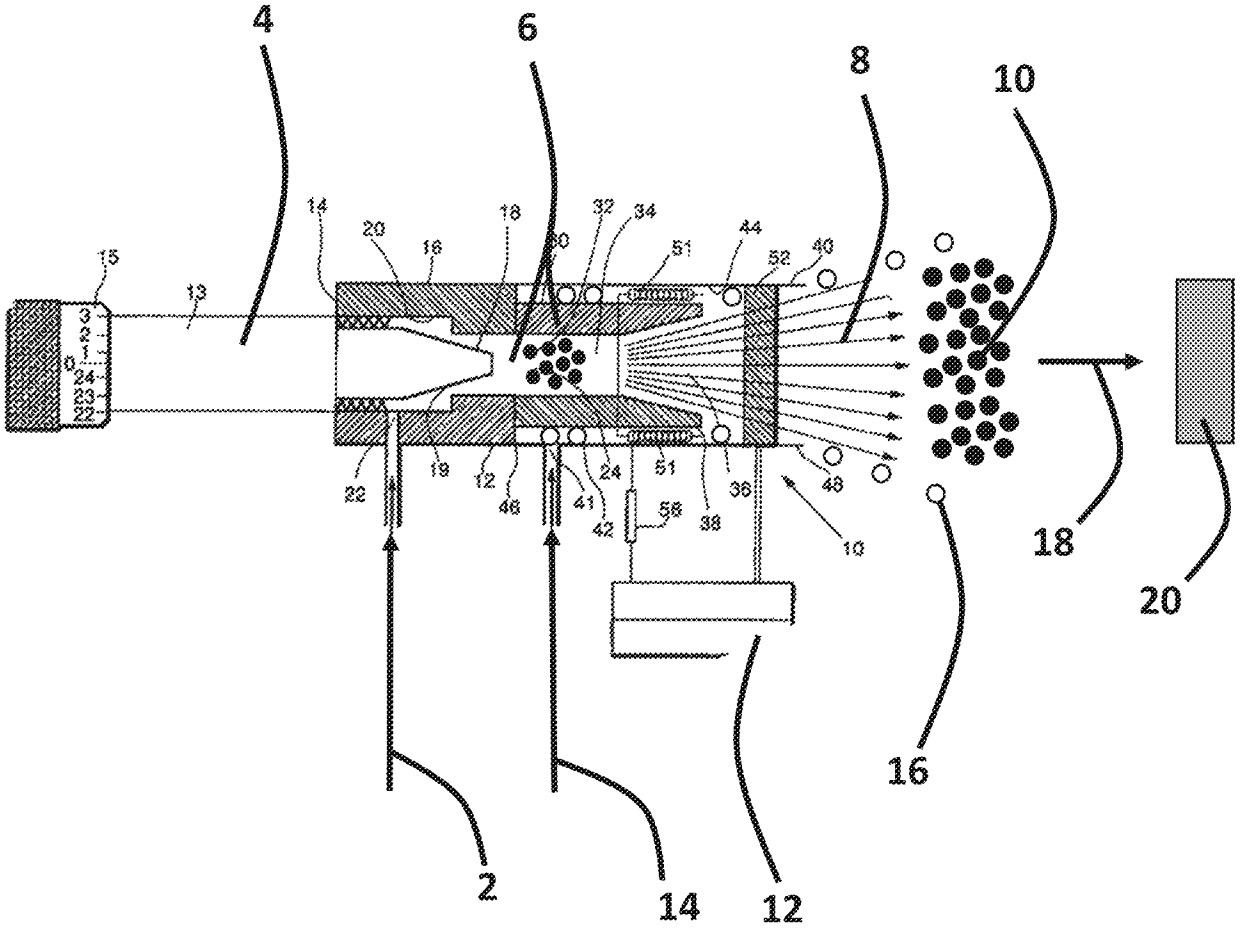
Fig. 1 Prior Art
FIG. 1 is an excerpt from prior art U.S. Pat. No. 5,409,418 (FIG. 1) describing a snow spray applicator with coaxial ionized gas additive injection means for use with a conventional $CO_2$ snow spray system.

FIG. 1 is an excerpt from prior art U.S. Pat. No. 5,409,418 (FIG. 1) describing a snow spray applicator with a coaxial ionized gas additive injection means for use with a conventional $CO_2$ snow spray system. Shown in FIG. 1, liquid $CO_2$ (2) is supplied though a micrometering valve (4) which adjustably meters the liquid $CO_2$ through an internal orifice of a snow spray nozzle (6) which rapidly expands (8) to form a very cold $CO_2$ gas-particle aerosol or snow spray (10). Surrounding said snow spray nozzle (6) is affixed an gas ionizing device (12) which produces a positive or negative high voltage potential through which a gas such as compressed air (14) is flowed into the ionizer means to produce a coaxial shield or shroud of ionized gas (16) circumferentially about the expanded snow stream (10) to form a cleaning spray comprising expanded $CO_2$ aerosol (10) and surrounding ionized air sheath (16), which is selectively projected (18) at a substrate surface (20). There are several drawbacks associated with conventional snow sprays such as '418 which have led to the development of a $CO_2$ composite spray by the first named inventor. These constraints include a very low spray temperature, atmospheric moisture and organic vapor condensation, and excessive $CO_2$ usage, among others. The ionization scheme of '418 injects ionized gas around a centrally disposed $CO_2$ snow stream. The centrally disposed $CO_2$ snow stream is much colder and denser than the circumferential ionized gas stream and is rapidly expanding in an outward direction away from the central spray axis at near-sonic velocity due to sublimation of the $CO_2$ particles. Although this scheme is useful for preventing external atmosphere from intruding into the centrally-disposed cold snow spray, and particularly near the cold cleaning zone on a substrate being treated by same, this additive injection arrangement hinders the uniform mixing of beneficial electrostatic charge neutralizing ions into the centermost regions of the spray and particularly the contact cleaning zone on the substrate itself. Moreover, the use of a high voltage ionization device on the spray cleaning nozzle is not desirable from a safety perspective and the requirement to utilize a bulky ionizer for each $CO_2$ spray nozzle increases equipment cost and constrains the development and use of $CO_2$ processing sprays having very high radial and aerial spray densities. Finally, the injection scheme of '418 cannot be used to inject liquid and solid additives to produce a homogenous $CO_2$ spray compositions for similar aforementioned constraints such as $CO_2$ snow spray expansion, flow stream segmentation, and very cold temperatures.

Figure 2:
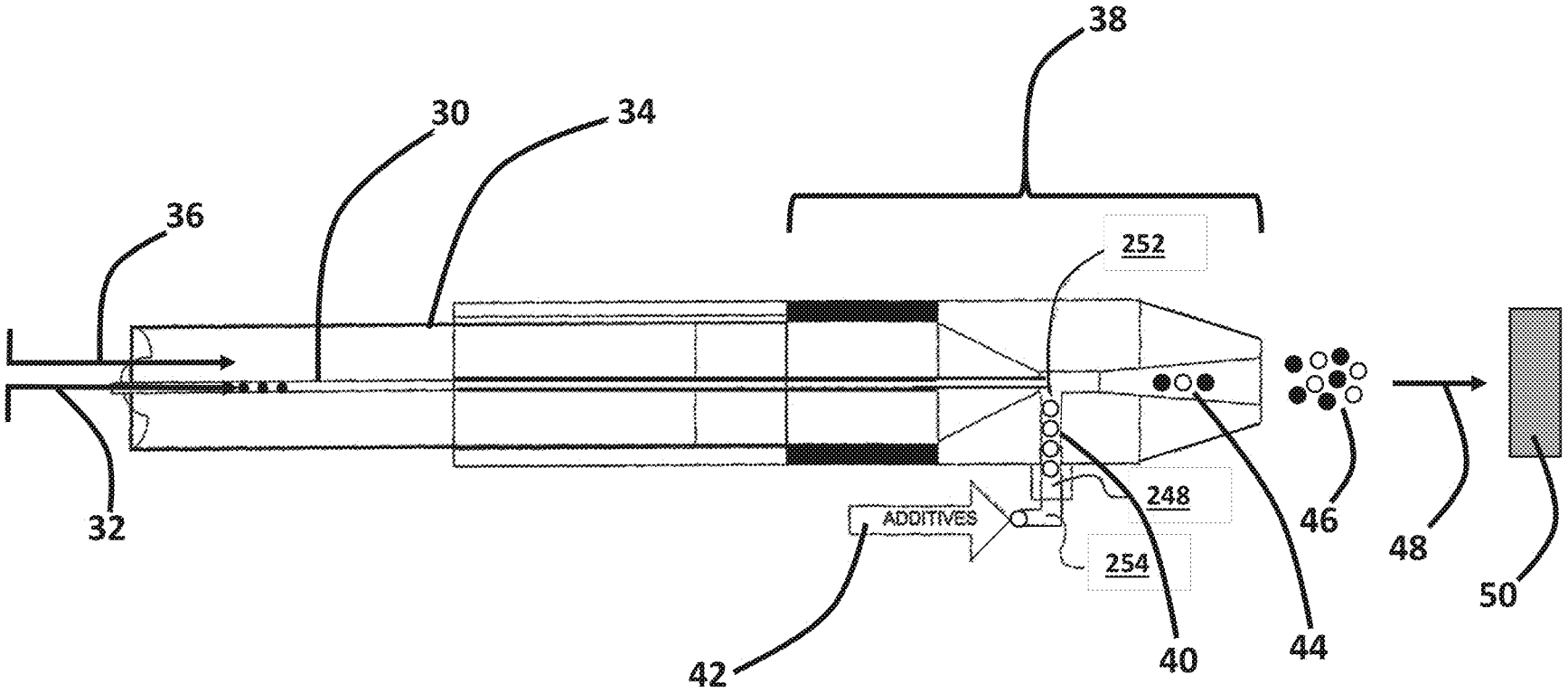
Fig. 2 Prior Art
FIG. 2 is an excerpt from prior art U.S. Pat. No. 7,451,941 (FIG. 5) dense fluid cleaning process and apparatus describing a coaxial spray applicator describing an internal coaxial additive injection means.

FIG. 2 is an excerpt from prior art U.S. Pat. No. 7,451,941 (FIG. 5) dense fluid cleaning process and apparatus describing a coaxial spray applicator describing an internal coaxial additive injection means. Shown in FIG. 2 is an exemplary coaxial $CO_2$ composite spray applicator and process developed by the first named inventor. Very different from a conventional snow spray applicator as previously discussed under FIG. 1, the basic scheme for producing and projecting a $CO_2$ Composite Spray (a trademark of CleanLogix LLC) is to combine essential components to form an effective $CO_2$-based processing spray: (1) cleaning agent (i.e., microscopic $CO_2$ particles), (2) $CO_2$ particle propulsion and spray shielding agent (i.e., heated, ionized, and pressurized air), and (3) optional spray additives (i.e., alcohol, microabrasive particles)—by means of separate spray component generation, control and delivery means, and integration of same using variously designed coaxial spray mixing nozzles. As depicted in FIG. 2, the exemplary coaxial $CO_2$ composite spray applicator comprises three basic elements; a coaxial $CO_2$ particle delivery capillary tube (30), which transports microscopic $CO_2$ particles (32) generated in-situ, carried within a portion of an outer coaxial propellant gas delivery tube (34), which transports a pressure-regulated and heated propellant gas (36); both of which are integrated to a coaxial $CO_2$-propellant gas mixing nozzle (38). In addition to these basic elements, an optional additive injection port (40) is employed to selectively feed pressure-flowable or pumpable spray cleaning additives such as solvents or microabrasives using an external additive feed tube (42) which injects the additive directly into the $CO_2$-propellant gas mixture (44) to form an air-$CO_2$-additive spray composition (46), which is then selectively projected (48) at a substrate surface (50). The spray generation process and apparatus thus described is detailed in U.S. Pat. No. 7,451,941 and is incorporated into this specification by reference to same.

A significant drawback of the exemplary coaxial spray applicator as shown and described under U.S. Pat. No. 7,451,941 (FIG. 2) is rapid internal nozzle clogging and spray aberrations such as sputtering particularly when injecting high melt point additives such as bio-based oils, or any additive that changes phase (i.e., liquid→solid) upon mixing with the $CO_2$ particles and before dispersion and atomization into fine particles. High velocity and sublimating $CO_2$ particle streams create passive electrostatic charging (as high as 5 kV or more) and very low mixing temperatures (as low as −109 Deg. F). The cold $CO_2$ particles thermally and electrostatically gel the high melt point lubricating oil during injection, forming large agglomerations of frozen $CO_2$ particles and oil which are not optimal for cooling-lubricating machining sprays. Similarly, injecting low melt point organic solvents such as acetone and methanol directly into the mixing nozzle for precision cleaning applications constrains the formation of small atomized solvent droplets with a uniform distribution of $CO_2$ particles. A large mass of organic solvent additive serves as a heat sink (and solvent) for the solute $CO_2$ particles during formation, causing the $CO_2$ particles to sublimate very quickly in transit to a surface. The result in a very short range cleaning spray containing a very cold atomized spray of liquid solvent absent any appreciable quantity of $CO_2$ particles.

Figure 3:
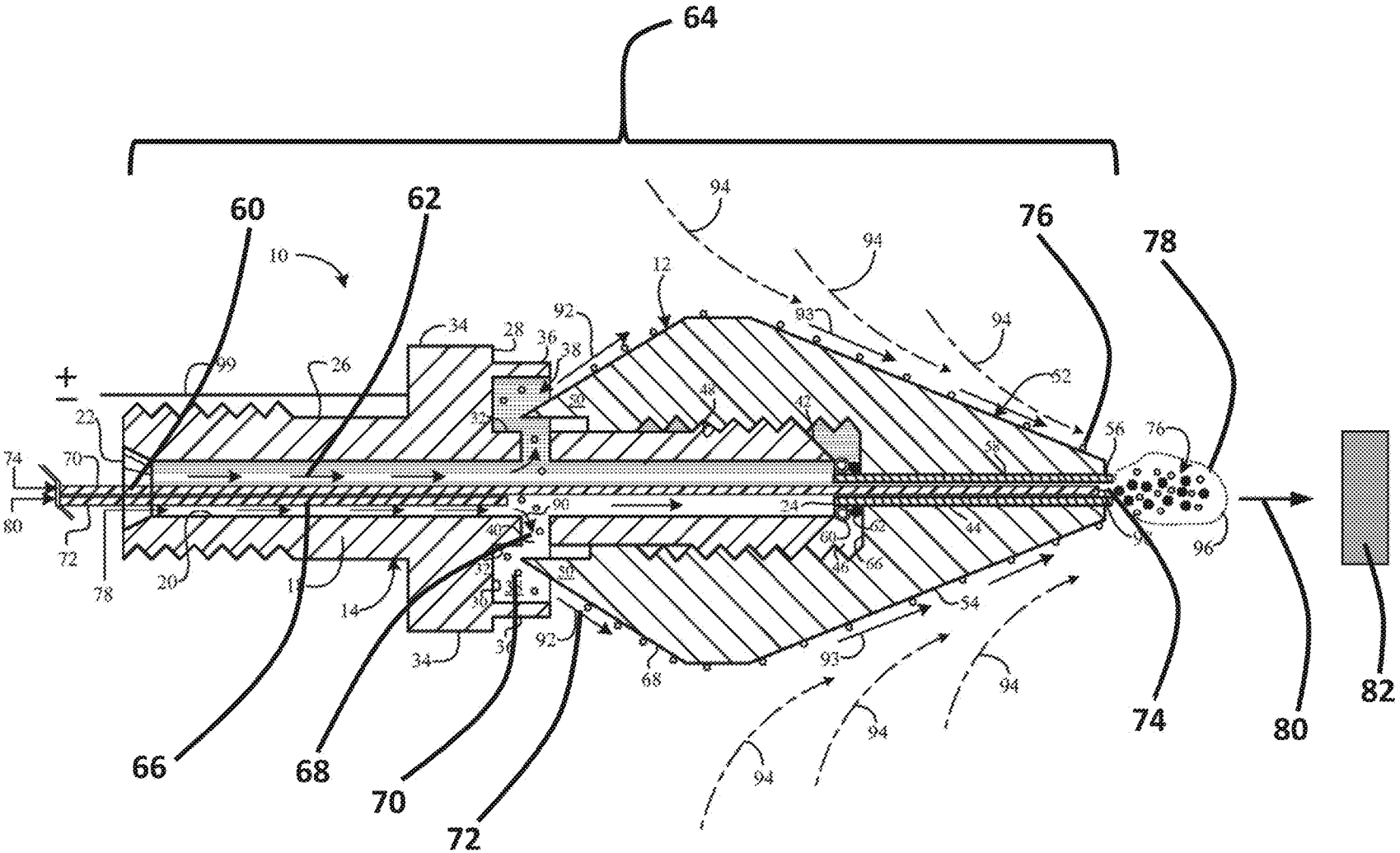
Fig. 3 Prior Art
FIG. 3 is an excerpt from prior art U.S. Pat. No. 7,389,941 (FIG. 2) describing a coaxial spray mixing nozzle using an external Coanda-flow additive injection means for use with exemplary $CO_2$ composite spray system described under FIG. 2, U.S. Pat. No. 7,451,941.

FIG. 3 is an excerpt from prior art U.S. Pat. No. 7,389,941 (FIG. 2) developed by the first named inventor describing a coaxial spray mixing nozzle using an external Coanda-flow additive injection means for use with the exemplary $CO_2$ composite spray system described under FIG. 2, U.S. Pat. No. 7,451,941. The novel spray nozzle of FIG. 3 is interchangeable with the coaxial spray nozzle described under FIG. 2 (38) and enabled with an exemplary $CO_2$ composite spray generation system described in U.S. Pat. No. 7,451,941. As shown in FIG. 3, $CO_2$ particles contained within a delivery capillary tube (60) flowing from an external $CO_2$ particle generator (not shown but described in detail under U.S. Pat. No. 7,451,941) are fed into and through the central portion of the nozzle, over which flows pressure- and temperature-regulated propellant gas (62) flowing from an external propellant supply generator (not shown but described in detail under U.S. Pat. No. 7,451,941); all of which are integrated into a Coanda-Coaxial $CO_2$-propellant gas-$CO_2$ particle-additive mixing nozzle (64). Different from the U.S. Pat. No. 7,451,941 externally fed additive injection and internal coaxial mixing method described under FIG. 2 (42), the additive injection feed tube (66) of U.S. Pat. No. 7,389,941 is carried internally and coaxially with the $CO_2$ particle feed tube (60) and is selectively positioned to inject additive (68) into an adjustable circumferential gap (70) which mixes and flows with a first portion of the propellant gas (62) from the nozzle interior and over the exterior surface of the Coanda nozzle surface (72). The capillary delivery tube (60) flowing $CO_2$ particles is selectively positioned to discharge the $CO_2$ particles near the nozzle exit port (74) whereupon the $CO_2$ particles are mixed and propelled with the second portion of propellant gas (62). The first portion of propellant gas and additive mixture flows over the outer surface the Coanda nozzle towards the nozzle tip (76), whereupon the propellant gas-additive mixture is injected into the second portion of propellant gas-$CO_2$ particle mixture exiting the nozzle exit port (74) to form a $CO_2$ particle-propellant gas-additive composition (78) which is projected (80) at a substrate surface (82). The Coanda nozzle apparatus thus described is detailed in U.S. Pat. No. 7,389,941 and is enabled by the spray generation process of U.S. Pat. No. 7,451,941 which is incorporated into this specification by reference to same.

As with the coaxial mixing nozzle of U.S. Pat. No. 7,451,941 described under FIG. 2 (38) with internal additive injection, the Coanda-flow external additive injection method of U.S. Pat. No. 7,389,941 described under FIG. 3 suffers similar constraints, albeit indirectly so. The external surface of the Coanda nozzle (76) is charged electrostatically and the surface temperature drops to very low temperatures during spray operation, both of which are caused by the internal expansion and sublimation of cold $CO_2$ particle-gas spray and mixing with the propellant gas within the nozzle body and near the nozzle exit (72). A means for mitigating the nozzle freezing effect is to significant increase the propellant gas temperature to offset sublimation cooling. However for machining applications, the propellant gas must not be heated above ambient temperature to preserve $CO_2$ particles (i.e., coolant) and to amplify the overall cooling capacity and effect of the composite spray. This phenomenon is best illustrated by comparing an air-$CO_2$ composite spray containing no additive with a spray containing a high melt point additive using the apparatus of FIG. 3.

Figure 4A:
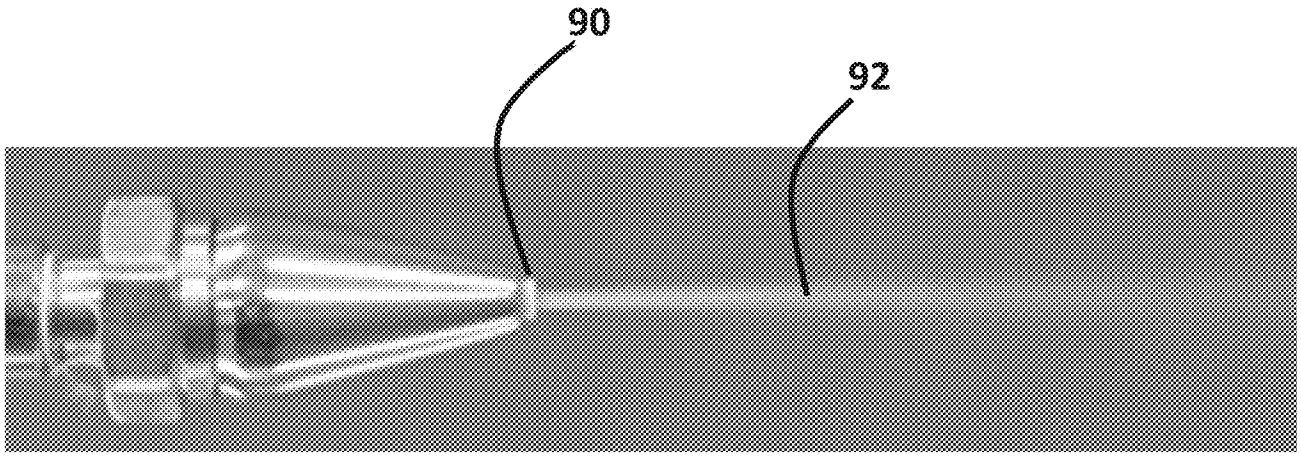
FIGS. 4*a* and 4*b* provide side-by-side photographs comparing an air-$CO_2$ composite cleaning spray with an air-$CO_2$-oil composite machining spray using a prior art Coanda spray apparatus and method of FIG. 3.
Figure 4B:
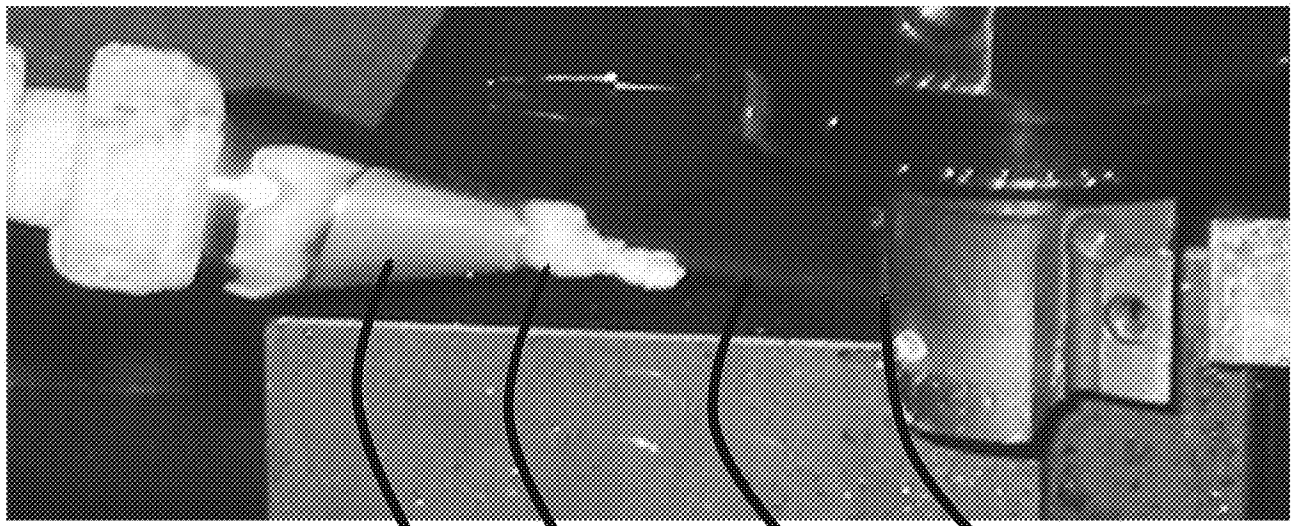

FIGS. 4*a* and 4*b* show side-by-side photographs comparing an unheated air-$CO_2$ composite spray with an unheated air-$CO_2$-oil composite spray using the prior art Coanda-Coaxial spray nozzle apparatus and method of FIG. 3. As shown in FIG. 4*a*, an unheated air-$CO_2$ composite spray exhibits atmospheric ice build-up on the nozzle tip (90) caused by electrostatic charging and water vapor condensation during spray operation, but overall the composite spray (92) remains well-formed and stable provided the $CO_2$ particle injection rate is kept controlled at about 8 lbs./hour (or less) and the propellant pressure is maintained at 70 psi and 70 degrees F. (or higher) to prevent excessive nozzle tip condensation and freezing. Now referring to FIG. 4*b*, and using these same air-$CO_2$ particle composite spray conditions as in FIG. 4*a*, a high melt point bio-based oil is injected through capillary feed tube FIG. 3 (66) at approximately 70 ml/hour. As can be seen in FIG. 4*b*, after a brief period of spray operation the oil additive begins to charge, gel and agglomerate along with atmospheric ice build-up on the entire Coanda injection surface (104). The build-up is observed as a frozen oily mass (106) that extends outward from the Coanda nozzle tip FIG. 4*a* (90). As this progresses, the nozzle tip build-up (106) interferes with the central $CO_2$ composite spray (108) and results in a cooling-lubricating spray that is unstable and variable, containing inconstant amounts of or no lubricant additive during application to cutting zone (110) comprising a cutting tool, workpiece, and chip.

The generation and projection of a $CO_2$ spray produces electrostatic charging. This tribocharging phenomenon is caused by contact of high velocity and sublimating $CO_2$ particles (a dielectric) with surfaces having a different work functions, for example polyetheretherketone (PEEK) delivery capillary tubes and metallic mixing nozzles used to fabricate a $CO_2$ composite spray applicator. Measures to mitigate electrostatic charge build-up and already discussed herein by reference to the prior art include the injection of ionized gases directly or indirectly into the $CO_2$ spray as well as nozzle grounding or shunting. However, even with these measures in place the $CO_2$ particle spray continues to tribocharge as it expands and moves turbulently within the atmosphere during its trajectory to a substrate surface. Moreover, even a relatively charge-neutral $CO_2$ spray will tribocharge a substrate surface during impingement. As such, it is known to those skilled in the art that the best remedy for mitigating electrostatic charge on the substrate surface during a $CO_2$ spray treatment is through substrate grounding or shunting means, and through the projection of a separate ionizing fluid or radiation at the substrate during spray treatment. For example, U.S. Pat. No. 9,352,355 co-developed by the first named inventor is an exemplary surface shunting means using an atmospheric plasma (electrically conductive treatment fluid) to contact both the $CO_2$ composite spray and substrate surface simultaneously during operation. Surface charge build-up is mitigated by draining tribocharge from the contacting surfaces directly into the plasma plume. The '355 apparatus and method is a hybrid treatment process that provides effective surface cleaning and modification while simultaneously controlling electrostatic charging of treatment spray and treated surfaces.

In summary, a direct charging method for intensifying the formation of an electrostatically-atomized additive in a $CO_2$ composite spray is taught by the first named inventor in U.S. Pat. No. 7,389,941 and involves the application of a high voltage (HV) to the flowable additive using a HV power supply and wire. The additive mixture becomes highly charged prior to injection into the Coanda nozzle and subsequent mixing into the tribocharged $CO_2$ composite spray. Also taught by the first named inventor in U.S. Pat. No. 7,451,941 is an indirect charging method which involves injecting additive directly into the tribocharged $CO_2$ composite spray as it is being formed to form a passively charged additive in the $CO_2$ composite spray. However it is evident from the discussion of the prior art, the co-joined constraints by both of these techniques, and particularly when using high melt point additives, are two-fold: (1) uncontrolled phase change of additive due to the very low $CO_2$ particle-gas mixture temperature (direct body-to-body heat transfer) with (2) premature electrostatic charging or tribocharging (direct body-to-body electrical charge transfer) of additive prior to atomization and condensation phenomenon. As such, the single-piece air-$CO_2$-additive mixing nozzle schemes used in the prior art have a significant conflict with regards to the locality of the electrostatic charging, additive injection, and mixing stages of $CO_2$ composite spray formation.

Having thus discussed the prior art in detail, it is apparent that there is a need for an improved $CO_2$ composite spray application method and apparatus. The following discussion describes aspects of a novel $CO_2$ composite spray applicator and method for coaxially injecting, atomizing, electrostatically charging, and dispersing virtually any flowable air-additive composition which resolves the aforementioned constraints. The present aspect provides an apparatus for producing an electrostatically charged and homogeneous $CO_2$ composite spray containing an additive.

In a first aspect of the present invention, $CO_2$ composite spray nozzles are employed as an axis-symmetrically arranged cathode array within which is located an additive injection nozzle behaving as an anode to create a strong ionizing electrostatic field between them in air during spray operation. The $CO_2$ composite spray nozzle and $CO_2$ particles are highly charged due to the presence of excess of electrons relative to its surroundings. The additive spray nozzle and atomized particles are oppositely charged with respect to the $CO_2$ composite spray. The inventors have measured the electrostatic field generated in the air surrounding a $CO_2$ composite spray mixing nozzle using an Exair Static Meter, Model 7905, available from Exair Corporation, Cincinnati, Ohio. A preferred $CO_2$ composite spray system for use with the present invention and co-developed by the first named inventor is U.S. Pat. No. 9,221,067 and is incorporated into this specification by reference to same. As depicted in '067 (FIG. 4*a*), an ungrounded coaxial $CO_2$ composite spray applicator using a single 0.008 inch PEEK capillary throttle ('067, FIG. 4*a* (114)) integrated into a stainless steel supersonic mixing nozzle ('067, FIG. 4*a* (116) was used. The coaxial $CO_2$ composite spray applicator was operated at a $CO_2$ throttle capillary pressure of 1200 psi, a propellant pressure of 80 psi, and a propellant temperature of 50 degrees C. Under these $CO_2$ composite spray conditions, a strong electrostatic field of 5 kV/inch is present at a position within the air gap surrounding and adjacent to said $CO_2$ spray mixing nozzle at approximately 1 inch away. As such, the $CO_2$ spray mixing nozzle (i.e., behaving as a cathode) emits a very strong and ionizing electrostatic field in air which can be used to electrostatically charge an adjacent and parallel flowing atmosphere of additive particles (i.e., behaving as an anode) in space separated by a dielectric air gap. The spray atomization, charging, and mixing stages are performed in air and downstream from the $CO_2$ particle and additive injection nozzles during trajectory to the substrate surface, mitigating spray formation constraints such as freezing, clogging and sputtering present in the prior art using an integrated air-$CO_2$-additive mixing nozzle scheme.

In another aspect, a cluster nozzle arrangement induces significant and parallel air flow symmetrically about the circumference of the $CO_2$ composite spray flow field due to the symmetry, multiplicity, and high velocity of the surrounding $CO_2$ composite sprays. A large inducement of air flow reduces atmospheric drag and extends the effective treatment range (i.e., spray trajectory) of the $CO_2$ composite spray.

In still another aspect of the present invention, the inner additive injection nozzle may use the same source of pressure and temperature regulated propellant gas as the $CO_2$ spray nozzles but uses a separate coaxial additive feed capillary from a remote additive supply. The mixing nozzle for the additive injector is designed to produce an atomized additive spray having velocity which is less (i.e., higher pressure) than the outer $CO_2$ spray nozzle array. This enhances incorporation of the atomized (and passively charged) additive particles into the axis-symmetrically arranged $CO_2$ composite sprays. These and other aspects of the present invention will be best understood by reference to FIGS. 5 through 14.

Figure 5A:
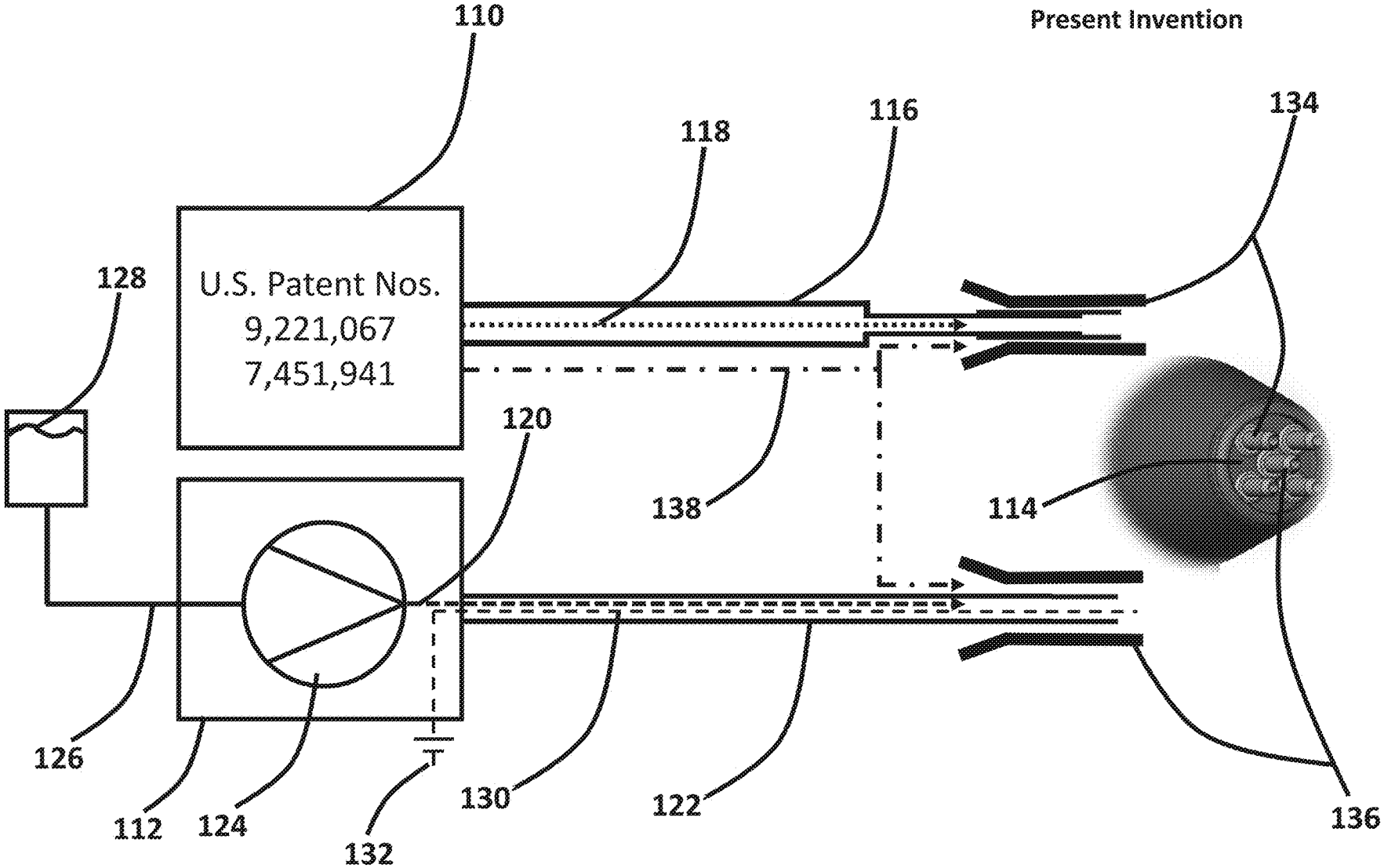
FIGS. 5*a* and 5*b* schematically illustrate basic aspects and functions of exemplary electrostatic field generating $CO_2$ composite spray nozzles, additive injector nozzle, and axis-symmetric clustering arrangement of same to form a passively charging $CO_2$ composite spray apparatus.
Figure 5B:
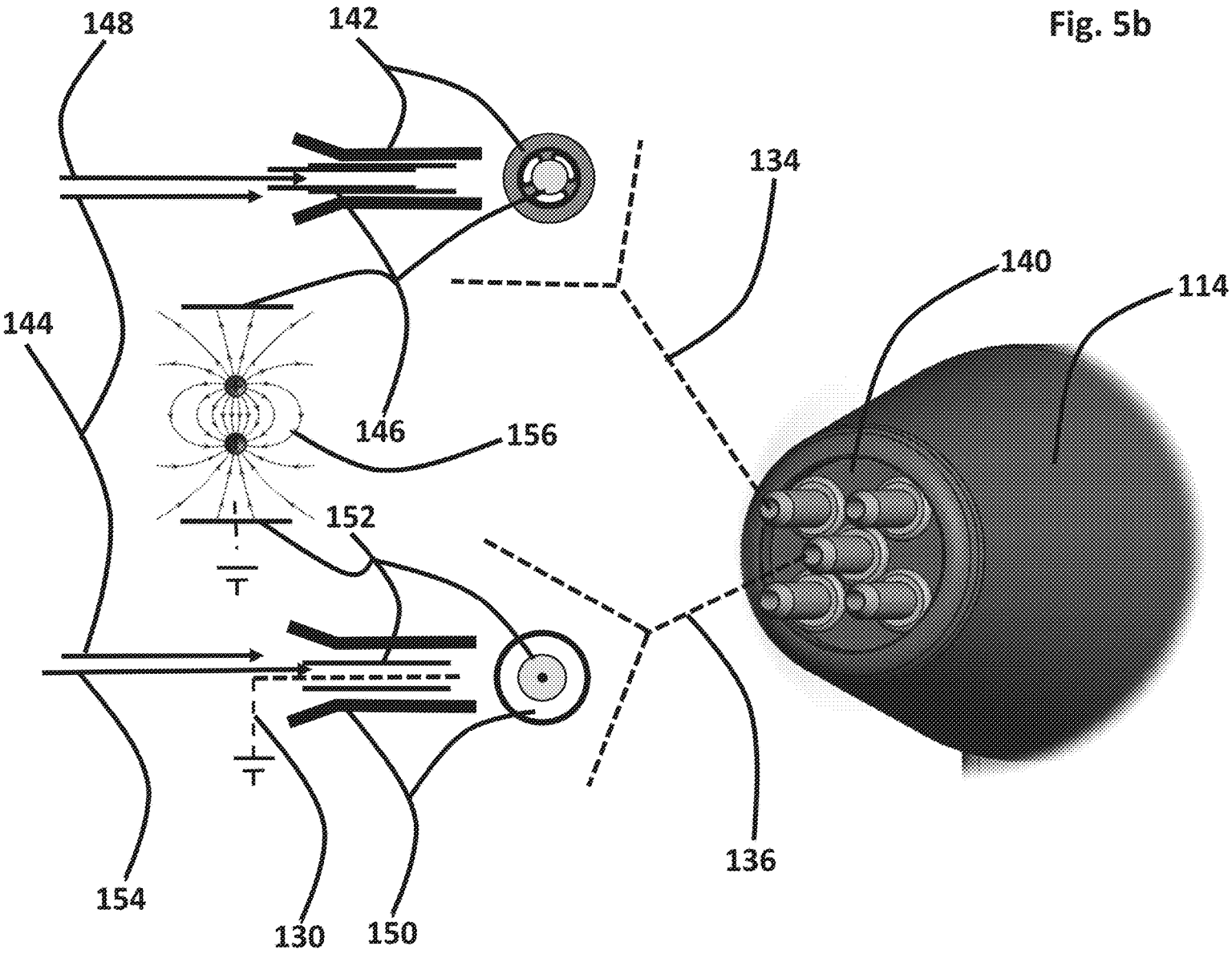

FIGS. 5*a* and 5*b* schematically illustrate basic aspects and functions of exemplary electrostatic field generating $CO_2$ composite spray nozzles, additive injector nozzle, and axis-symmetric clustering arrangement of same to form a passively charging $CO_2$ composite spray apparatus. Shown in FIG. 5*a*, three basic components are needed for practicing the present invention. These include a $CO_2$ composite spray generation system (110), an additive injection system (112), and the present invention, a passive electrostatic $CO_2$ composite spray applicator (114). The exemplary passive electrostatic $CO_2$ composite spray applicator (114) shown in FIG. 5*a* is fluidly connected to both the $CO_2$ composite spray generation system (110) and additive injection system (112) vis-à-vis flexible and coaxial fluid delivery line and tube assemblies. The $CO_2$ composite spray delivery assembly comprises a polyetheretherketone (PEEK) capillary tube (116) providing a pressure- and temperature-regulated supersaturated $CO_2$ fluid (118). The additive injection system (112) provides adjustable volume of additive (120) vis-à-vis a flexible capillary delivery tube (122) using a pressure-regulated pump (124) supplied by an additive feed line (126) from a reservoir (128) containing a liquid additive or mixture of additives comprising liquids and solids. The additive delivery tube (122) contains an optional small grounding wire (130) which is connected to earth ground (132) and traverses the entire inside length of the inside of the additive delivery tube (122). The grounding wire (130) serves as an electrostatic charge inductor for the additive flowing through the additive delivery tube (122). The passive electrostatic $CO_2$ composite spray applicator (114) contains an array of two or more $CO_2$ composite spray mixing nozzles (134) positioned axis-symmetrically about a single additive injection nozzle (136). The $CO_2$ composite spray mixing nozzle (134) combines pressure- and temperature-regulated propellant gas (138) and micronized $CO_2$ particles generated in the nozzle (134) from the supersaturated $CO_2$ (118), both fluids provided by the $CO_2$ composite spray generator (110), to form a $CO_2$ composite spray (not shown). The additive injection nozzle (136) combines the same pressure- and temperature-regulated propellant gas (138) and additive fluid (120) to form an atomized additive spray (not shown). Preferred $CO_2$ composite spray generation systems (110) for use with the present invention are described in detail under U.S. Pat. Nos. 9,221,067 and 7,451,941, available commercially from CleanLogix LLC, Santa Clarita, Calif., both of which are incorporated into this specification by reference to same. Exemplary additive injection systems (112) and bio-based metalworking lubricant additives (120) suitable for use with the present invention are available from ITW ROCOL North America, Glenview, Ill.

FIG. 5*b* provides a more detailed description of the exemplary $CO_2$ composite spray nozzles (134) and single additive injection nozzle (136) shown in FIG. 5*a*. Shown in FIG. 5*b*, the passive electrostatic $CO_2$ composite spray applicator (114) comprises a single additive injection nozzle (136) positioned centrally between multiple $CO_2$ composite spray nozzles (134), all of which is positioned on a face of a cylindrical or tubular spray applicator body (140). The $CO_2$ composite spray nozzles (134) are fabricated from materials which will passively tribocharge when contacted with $CO_2$ particles, for example metals such as stainless steel will produce a very strong electrostatic field during $CO_2$ tribocharging. The spray applicator body (140) may be constructed of various materials including for example stainless steel, aluminum, or polymers such as Delrin®. Moreover, the spray applicator body (140) may be contained in a 3D-printed applicator housing to provide a means for mounting or handling, and manipulating the spray applicator body (140) during operation, for example providing mounts for a robot end-effector or providing a handle for manual spray operations.

Having described the general features and arrangement of the passive electrostatic $CO_2$ spray applicator, following is a more detailed description of the $CO_2$ composite spray nozzles (134) and additive injection spray nozzle (136). Referring to the exemplary $CO_2$ composite spray nozzle (134), the coaxial $CO_2$ spray nozzle comprises two components: (1) an outer propellant gas conduit (142) for flowing pressure- and temperature-controlled propellant gas (144), and (2) an inner polymeric $CO_2$ particle conduit (146) for flowing micronized $CO_2$ particles (148). The preferred construction and arrangement of the coaxial $CO_2$ composite spray nozzle (134) is described in detail in U.S. Pat. Nos. 9,221,067 and 7,451,941, both of which are incorporated into the present invention by reference to same.

Referring to the exemplary additive injection spray nozzle (136), the coaxial additive spray nozzle comprise three components: (1) an outer propellant gas conduit (150) for flowing pressure- and temperature-controlled propellant gas (144), which for this exemplary applicator is the same source as for the $CO_2$ composite spray nozzle (134), (2) an inner polymeric additive conduit (152) for flowing a pressure- and temperature-regulated additive (154), and (3) an optional metallic grounding wire (130) which traverses the length of the additive injection tube (FIG. 5*a*, 122) supplying the additive injection nozzle (136). Finally, during operation of the exemplary passive electrostatic $CO_2$ composite spray applicator thus described, $CO_2$ particle tribocharging within the polymeric $CO_2$ particle additive conduit (146) and metallic nozzle (142) produces an electrostatic field (156) between the $CO_2$ spray nozzle (134) and additive injection spray nozzle (136).

Figure 6C:
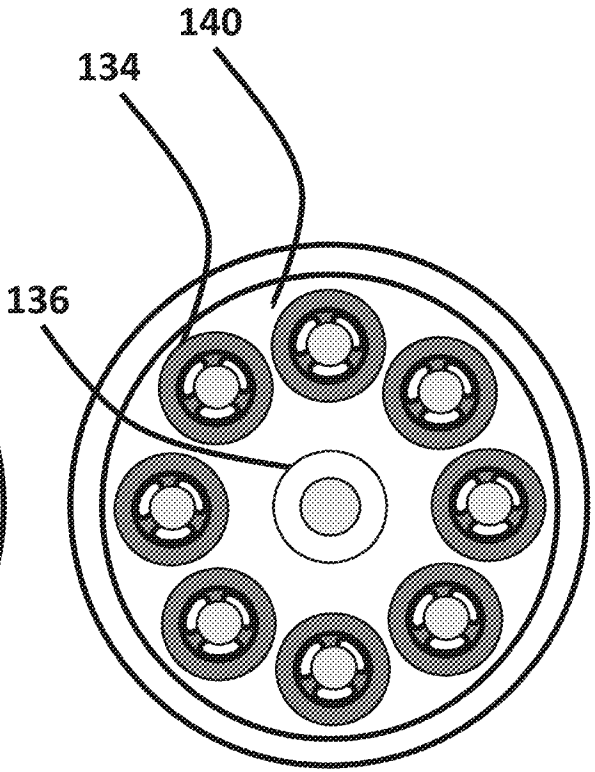
FIGS. 6*a*, 6*b*, and 6*c* illustrate exemplary axis-symmetric cluster spray nozzle configurations for use with the present invention.
Figure 6B:
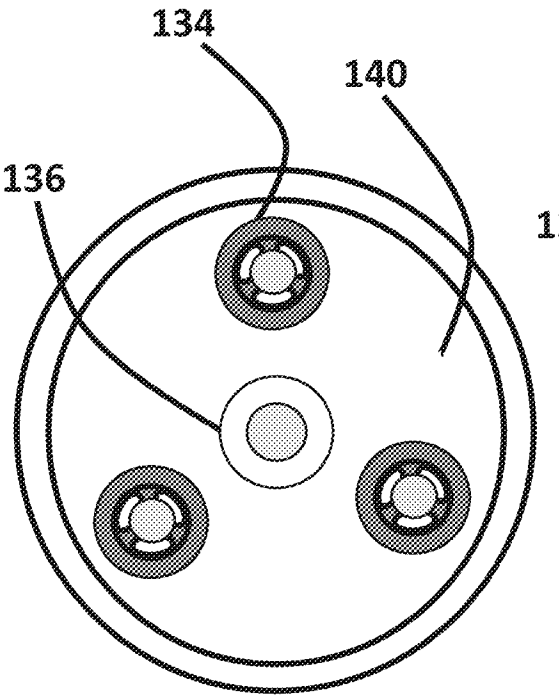
Figure 6A:
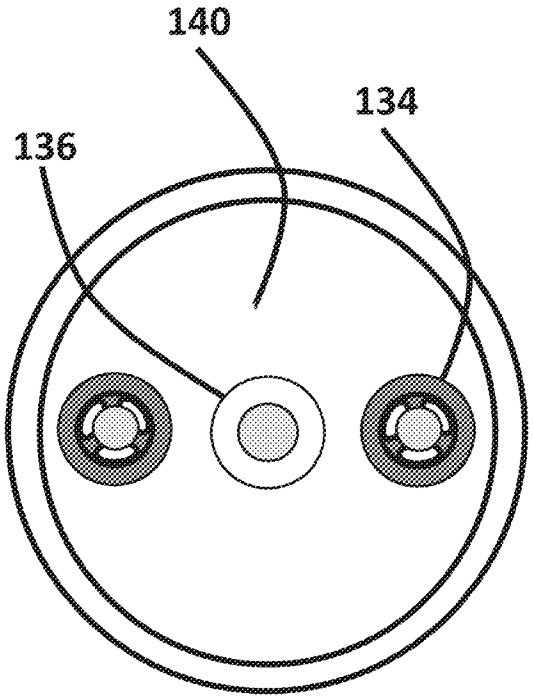

FIGS. 6*a*, 6*b*, and 6*c* illustrate exemplary axis-symmetric cluster spray nozzle configurations for use with the present invention. FIG. 6*a* illustrates a 2×1 cluster nozzle arrangement comprising one additive injection nozzle (136) bounded axis-symmetrically on a common spray applicator body (140) by two $CO_2$ composite spray nozzles (134). FIG. 6*b* illustrates a 3×1 cluster nozzle arrangement comprising one additive injection nozzle (136) bounded axis-symmetrically on a common spray applicator body (140) by three $CO_2$ composite spray nozzles (134). Finally, FIG. 6*c* illustrates an 8×1 cluster nozzle arrangement comprising one additive injection nozzle (136) bounded axis-symmetrically on a common spray applicator body (140) by eight $CO_2$ composite spray nozzles (134).

Figure 7B:
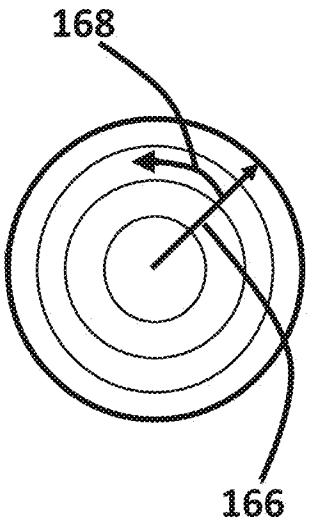
FIGS. 7*a* and 7*b* illustrate an arrangement of multiple cluster spray applicators to adjust both aerial and radial spray density.
Figure 7A:
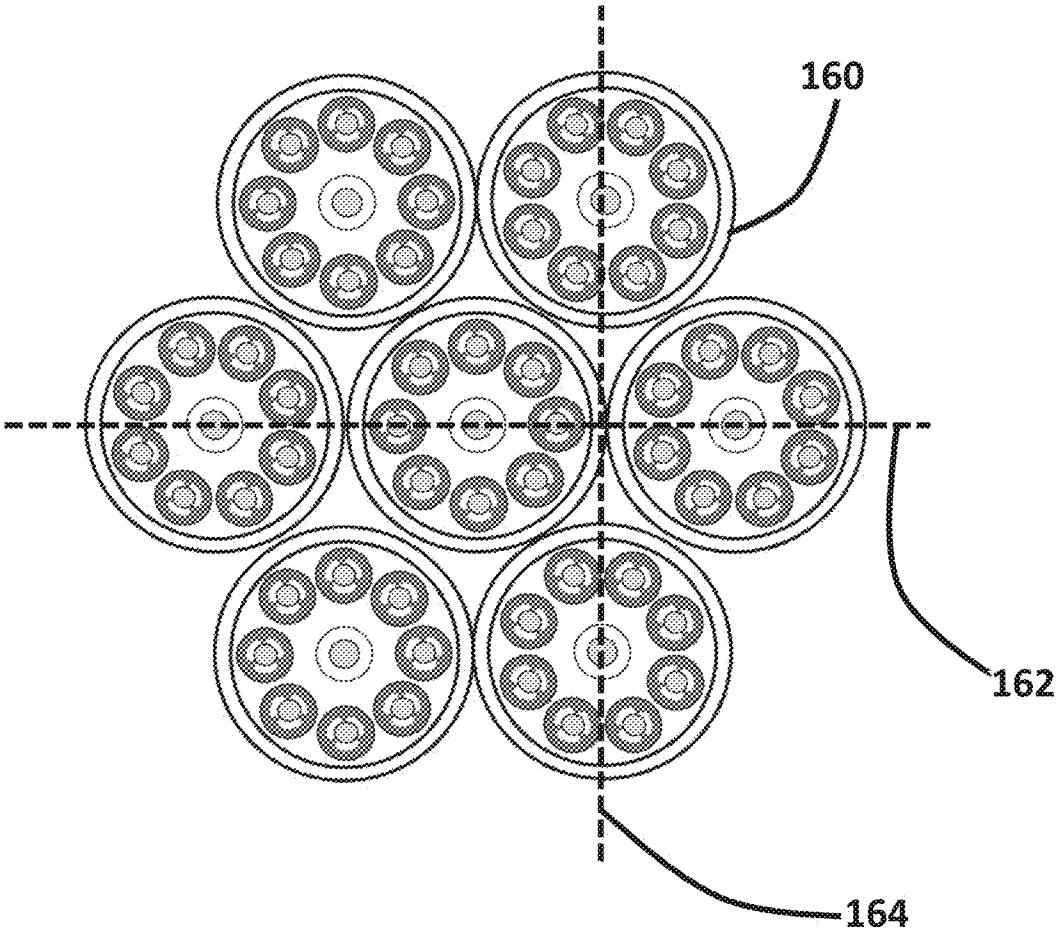

FIGS. 7*a* and 7*b* illustrate an arrangement of multiple cluster spray applicators to adjust both aerial and radial spray density. FIG. 7*a* illustrates an axis-symmetric arrangement of seven 8×1 cluster spray nozzles (160). The individual cluster spray applicators may also be rotated to produce overlapping sprays in both the x axis (162) and y axis (164). As shown in FIG. 7*b*, using multiple cluster spray applicators having different spray nozzle configurations and rotations provides the adjustment of both the radial spray density (166) and aerial spray density (168).

Figure 8:
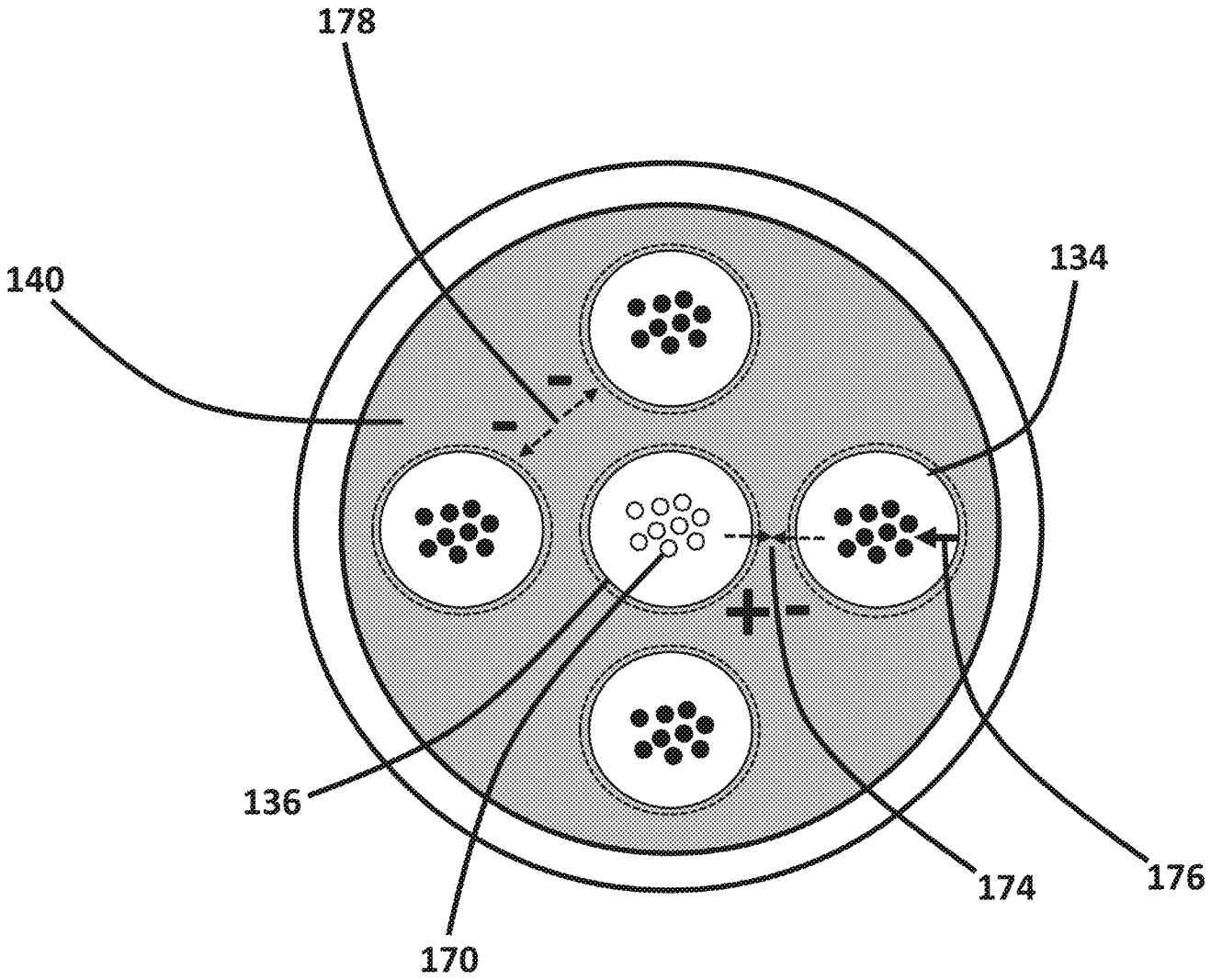
FIG. 8 is a schematic showing the symmetrical electrostatic field established about a centrally disposed floating ground additive injector nozzle and between axis-symmetrically disposed floating charge carrier nozzles.

FIG. 8 is a schematic showing the symmetrical electrostatic field established about a centrally disposed additive injector nozzle and between axis-symmetrically disposed charged carrier nozzles. FIG. 8 shows a central metallic additive nozzle (136) producing atomized additive particles (170) positioned between axis-symmetrically arranged $CO_2$ composite spray nozzles (134) producing charged $CO_2$ composite spray particles (172), all of which positioned on the face of a spray applicator body (140). The atomized additive particles (170) are relatively charge neutral or positive relative to the axis-symmetrical metallic $CO_2$ spray nozzle (134) which produces negatively charged $CO_2$ particles (172). The result of this arrangement during spray operation is the establishment of an electrostatic field (174) between the central and outer spray nozzles. The passive electrostatic spray applicator of the present invention comprises an additive injection nozzle (136) behaving as a central anode and the axis-symmetrically arranged $CO_2$ composite spray nozzles (134) behaving as charged cathodes. Electrons are produced by the tribocharging of $CO_2$ particles between internal capillary and nozzle body surfaces (176) within the $CO_2$ spray nozzle (134). Moreover, the charged $CO_2$ composite sprays repel each other (178) due to equal electrostatic charge. Electrostatic repulsion in combination with a higher velocity than the central additive spray maintains the symmetry of the sprays and slightly delays incorporation of the additive until downstream of the cluster spray nozzle array.

Figure 9:
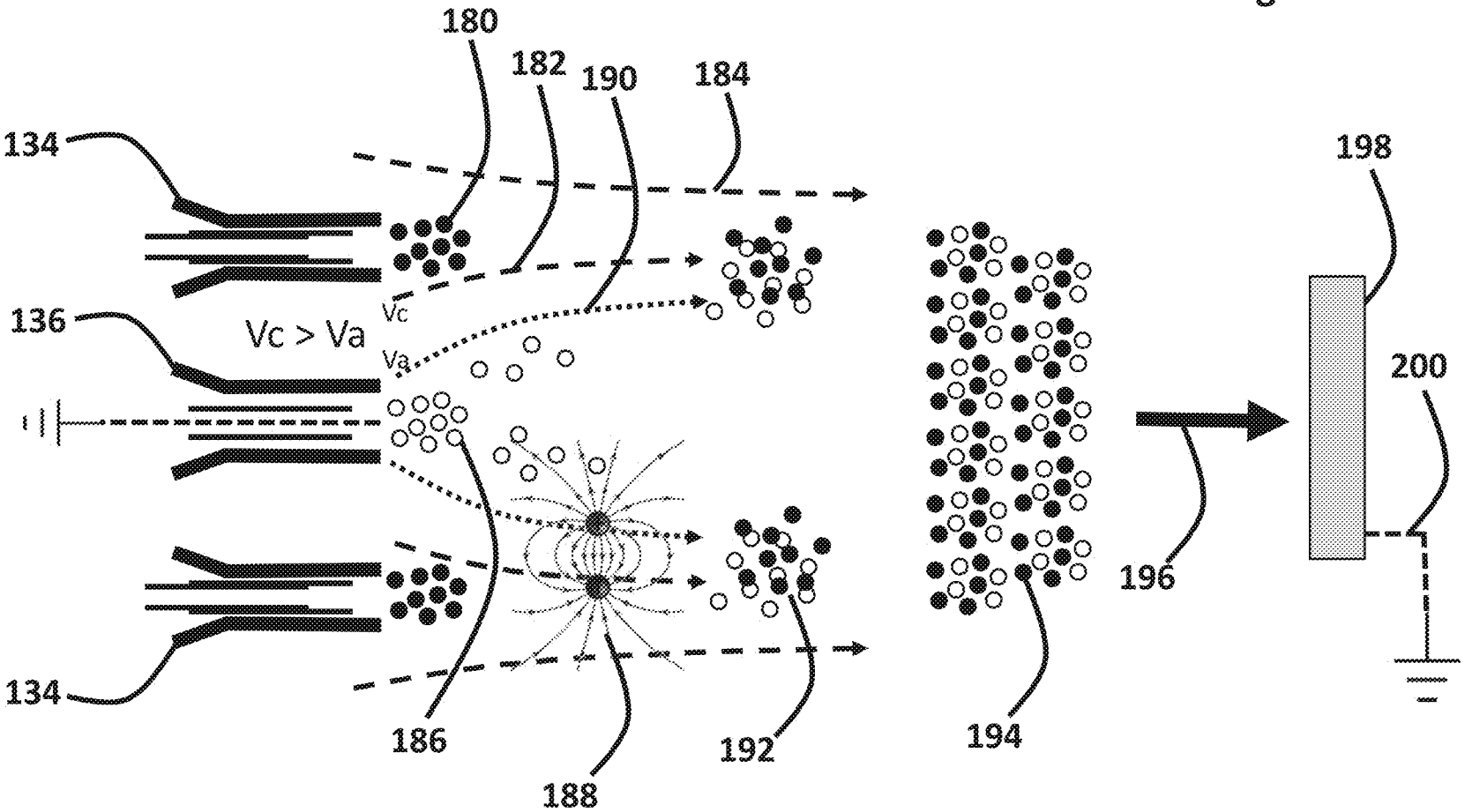
FIG. 9 describes the formation of a composite spray in space comprising passively charged $CO_2$ particles and additive particles in air, and application to an exemplary substrate.

FIG. 9 describes the formation of a $CO_2$ composite spray in space comprising passively charged $CO_2$ particles and additive particles in air, producing an electrostatically charged and homogeneous $CO_2$ composite spray mixture containing an additive, and application of same to an exemplary substrate. Shown in FIG. 9, a basic passive electrostatic $CO_2$ composite spray cluster nozzle discussed herein is a 2×1 axis-symmetrical arrangement of spray nozzles comprising a centrally-positioned additive injection nozzle (136) surrounded by two $CO_2$ composite spray nozzles (134). Tribocharged $CO_2$ particles entrained and propelled by a pressure- and temperature-regulated propellant gas stream form an air-$CO_2$ composite spray (180), which is projected into space at a velocity (Vc) which is greater than the additive injection spray. The air-$CO_2$ composite spray (180) thus formed induces atmospheric air flow (182) in the space between the $CO_2$ spray nozzle (134) and additive injection nozzle (136), and induces atmospheric air flow (184) the circumferential space about the cluster spray nozzle applicator. Relatively charge-neutral and atomized additive particles entrained in the same pressure- and temperature-regulated propellant gas stream form an air-additive spray (186) which is moving at a velocity (Va) less than the $CO_2$ composite spray. Discussed in more detail under FIG. 11 and FIG. 12 herein, the velocity differential between the $CO_2$ spray nozzles (134) and additive injection spray nozzle (136) at an equivalent propellant pressure input is accomplished using different nozzle designs. During spray operation this cluster nozzle arrangement produces both an electrostatic field (188) and spray velocity (190) gradient, which results in rapid electrostatic charging and entrainment of additive particles by the $CO_2$ composite spray to form an air-additive-$CO_2$ composite spray (192) downstream from spray applicator. At a distance downstream from the cluster spray applicator nozzles, which is dependent upon propellant pressure input, the air-additive-$CO_2$ composite sprays mix to form a homogenously charged and additive-dispersed $CO_2$ composite spray (194) which is directed (196) at a substrate surface (198). The substrate surface (198) may be earth grounded (200) or may behave as a relative ground with respect to the highly charged air-additive-$CO_2$ particle aerosol spray (194).

FIGS. 10*a*, 10*b*, 10*c*, 10*d*, and 10*e* provide side, back and front, and a sliced isometric view of an exemplary design for a passive electrostatic charge generation $CO_2$ composite spray nozzle for use with the present invention. Shown in FIG. 10*a* (side view), the exemplary $CO_2$ composite spray nozzle (134) is a stainless steel coaxial propellant gas-$CO_2$ particle mixing body having a threaded base (210) which allows for attachment to axis-symmetric circumferential positions on the spray applicator body (FIG. 5*b*, 140), a chamfered nozzle exit (212), and through-ported interior space (214) for insertion and centering of a PEEK $CO_2$ particle delivery tube (not shown) bounded by three lobed propellant gas flow channels (216). The propellant gas flow channels (216) are produced using electrical discharge machining (EDM) and provide a three-point cradle for centering and securing the PEEK $CO_2$ particle delivery tube (not shown) surrounding which flows supersonic velocity propellant gas. Shown in FIG. 10*b* (back view), the threaded base (210) contains a nozzle sealing face (218) and interior through-ported space shows the flat cradle base (220) onto which the PEEK $CO_2$ particle delivery tube (not shown) slides into position between the intersection of any two EDM propellant flow channels (216). Finally, shown in FIG. 10*c* (Front View) the exemplary $CO_2$ composite spray nozzle contains a center-positioned adjustable expansion tube assembly (222) (by reference to U.S. Pat. No. 9,221,067 (FIG. 4*b*, "Adjustable Expansion Tube Assembly", (502)), which is cradled between at least three or more center-positioning and shunting bars (220) created at the intersections between the three EDM propellant flow channels (216). The exemplary coaxial $CO_2$ composite spray nozzle thus described produces a flow of air and $CO_2$ particles having a velocity which is higher than the additive injection spray nozzle.

Figure 10B:
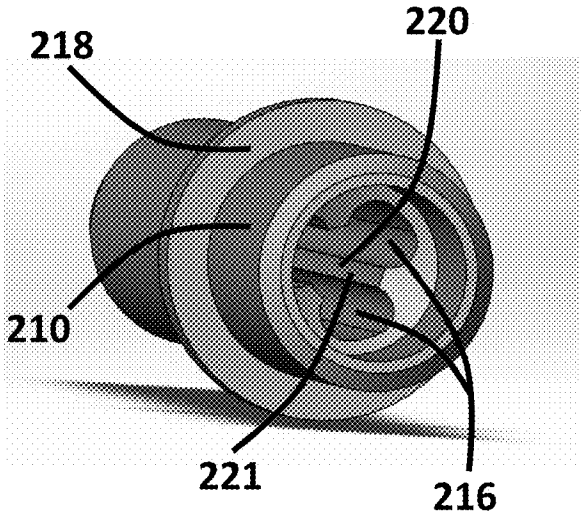
FIGS. 10*a*, 10*b*, 10*c*, 10*d*, and 10*e* provide side, back and front, and a sliced isometric view of an exemplary design for a passive electrostatic charge generation $CO_2$ composite spray nozzle for use with the present invention.
Figure 10A:
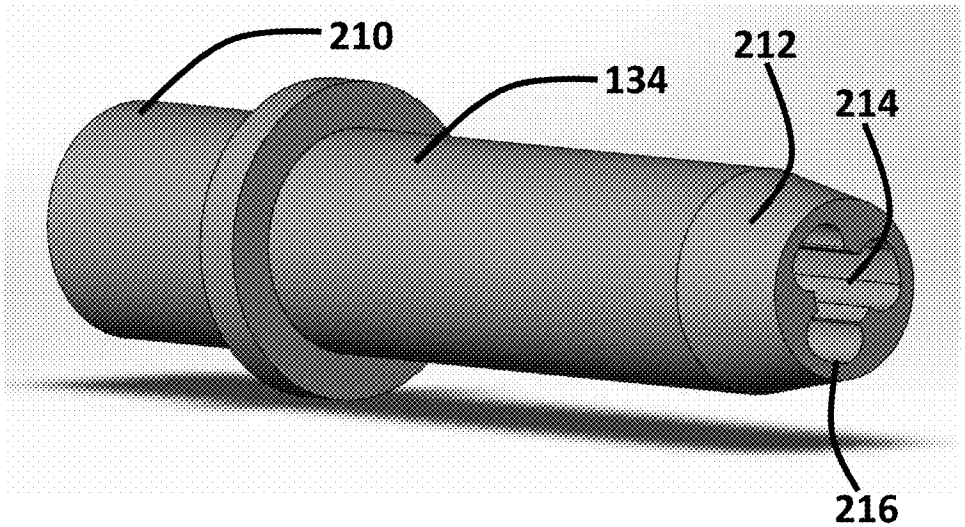
Figure 10C:
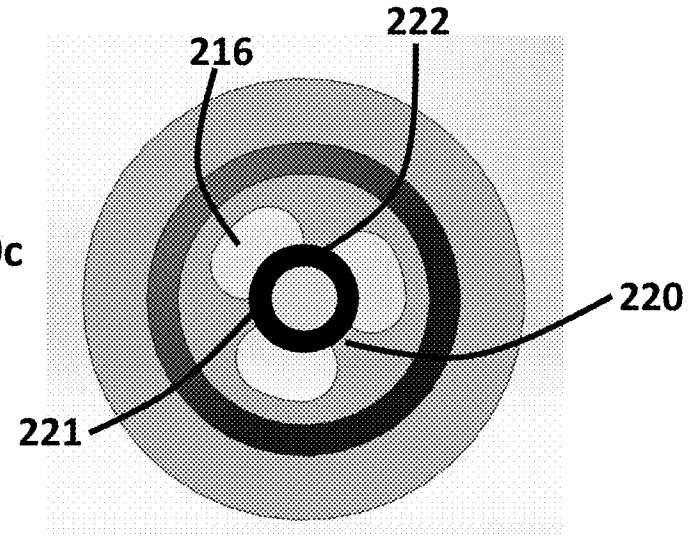
Figure 10E:
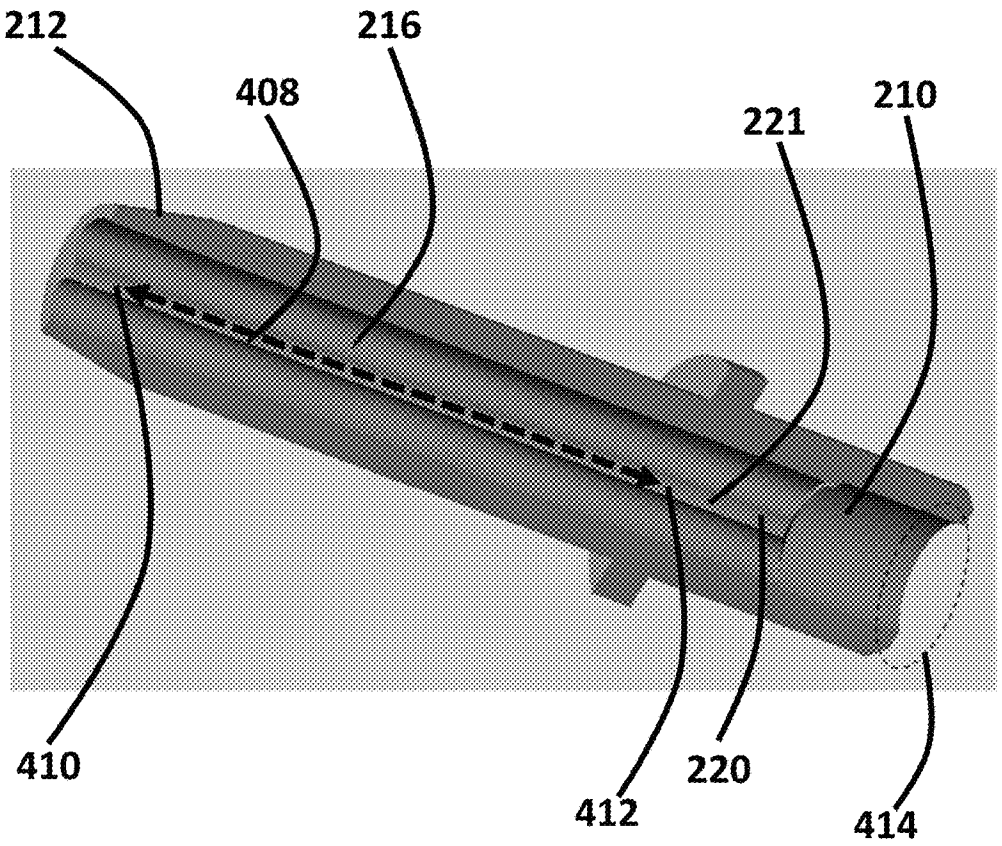
Figure 10D:
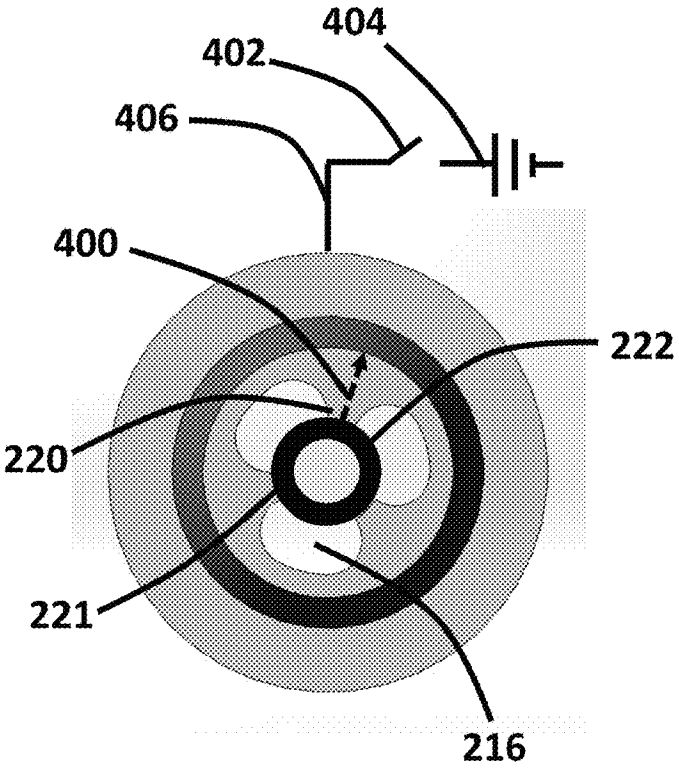

FIG. 10*d* and FIG. 10*e* provide a more detailed view of the interior design and operational aspects of the $CO_2$ composite spray nozzle of the present invention. FIG. 10*d* is a front view of the exemplary $CO_2$ composite spray nozzle. With reference to U.S. Pat. No. 9,221,067 (FIG. 4B, "Adjustable Expansion Tube Assembly", (502)) by the first named present inventor, the $CO_2$ composite spray nozzle of the present invention provides a novel method and apparatus for centering and positioning the referenced adjustable expansion tube assembly (222) described in '067 (FIG. 4*b*) which injects micronized $CO_2$ particles into the propellant gas flowing through the EDM propellant channels (216), and for selectively shunting (400) and directing the electrostatic charges generated within same. With the shunting circuit (402) connected to ground (404), electrostatic charges are directed from the outside surfaces of the adjustable expansion tube assembly (222) and nozzle surface (406) along and through the internal EDM shunting bars (220). Now referring to FIG. 10*e*, the relatively long and internal EDM shunting bars (220) have a length between 0.25 inches to 6 inches, or more, and the adjustable expansion tube assembly of FIG. 10*d* (222) is selectively positioned within the centermost region of the nozzle body along the traverse (408) of the EDM shunting bars (220) from the nozzle tip (410) to a position within the nozzle cavity (412). The diameter between the three or more EDM shunting bars (220) is pre-determined to provide a slip contact fit between the shunting bar land surfaces and the outside surfaces of the adjustable expansion tube assembly of FIG. 10*d* (222). The discharge (or injection) position of the adjustable expansion tube assembly (FIG. 10*d* (222)), and particularly where the micronized $CO_2$ particles are injected into the supersonic propellant flow channel (216), is determined based on the development of an optimal spray plume profile for the $CO_2$ composite spray as determined using U.S. Pat. No. 9,227,215 by the first named inventor of the present invention. Finally, the shunting mechanism described under FIG. 10*d* is implemented by the selective application of a grounding element (414) for the nozzle body. If the nozzle connection (414) is grounded, electrostatic charges flow away from the nozzle body and into earth ground. If the nozzle connection (414) is ungrounded, electrostatic charges a stored within and drained from the nozzle body tip (410) into the spray stream.

Figure 11B:
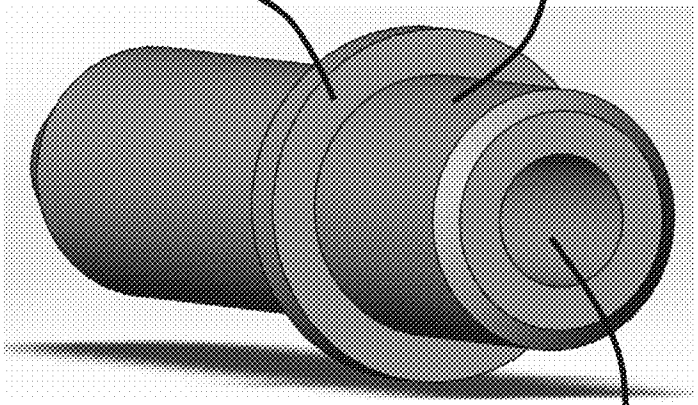
FIGS. 11*a*, 11*b*, and 11*c* provide side, back and front isometric views of an exemplary design for an exemplary atomizing additive injector nozzle for use with the present invention.
Figure 11C:
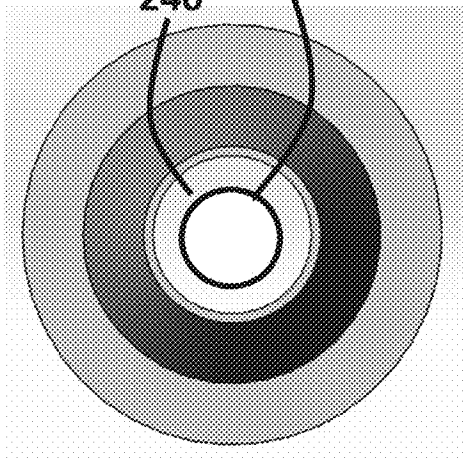
Figure 11A:
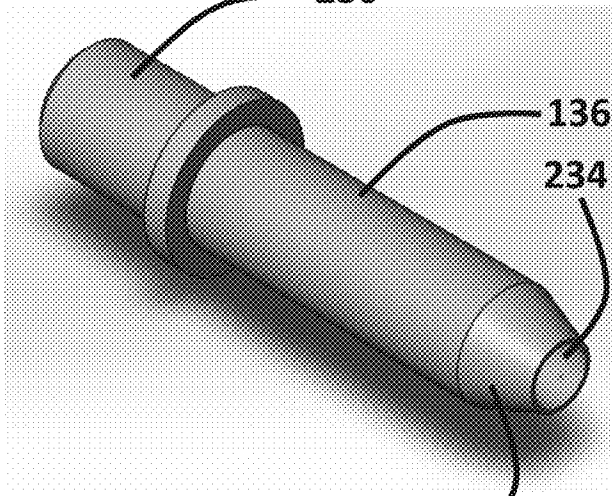

FIGS. 11*a*, 11*b*, and 11*c* provide side, back and front isometric views of an exemplary design for an exemplary atomizing additive injector nozzle for use with the present invention. Shown in FIG. 11*a* (side view), the exemplary additive injection spray nozzle (136) is a stainless steel coaxial propellant gas-additive particle mixing body having a threaded base (230) which allows for attachment to the centermost position of the spray applicator body (FIG. 5*b*, 140), a chamfered nozzle exit (232), and through-ported circular interior space (234) for insertion of a PEEK additive delivery tube (not shown). With equivalent propellant gas pressure, the circular propellant gas flow channel (234) of FIG. 11 flows a lower velocity propellant gas as compared to the EDM propellant flow channels described under FIG. 10 by virtue of having a larger surface area. Shown in FIG. 11*b* (back view), the threaded base (230) contains a nozzle sealing face (236) and interior through-ported circular space (234) within which the PEEK additive particle delivery tube (not shown) is somewhat centrally positioned. Finally, shown in FIG. 11*c* (Front View) the exemplary additive particle spray nozzle contains a somewhat center-positioned and slightly recessed PEEK additive particle delivery tube (238) about which forms a circular propellant gas flow channel (240). The exemplary coaxial additive injection nozzle thus described produces a flow of air and additive particles which has a velocity which is less than the $CO_2$ spray produced by the $CO_2$ composite spray nozzle described under FIG. 10.

Figures 12A, 12B, 12C:
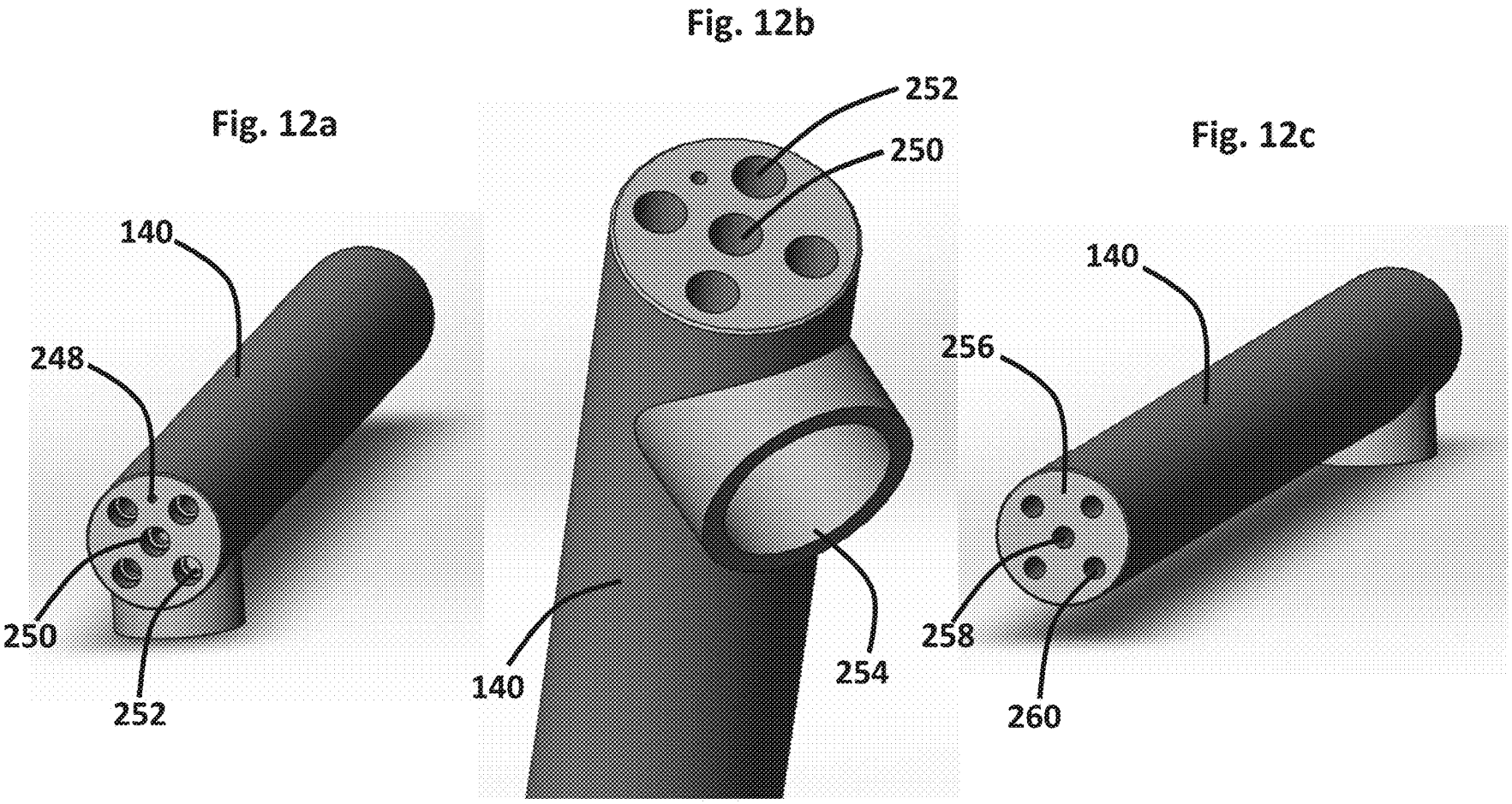
FIGS. 12*a*, 12*b*, and 12*c* provide rear, bottom and front facing isometric views of an exemplary design for a 4×1 cluster spray applicator body for axis-symmetrically arranging the $CO_2$ composite spray nozzles and additive injection nozzle, and means for providing propellant air, $CO_2$ particles, and additives for using same.

FIGS. 12*a*, 12*b*, and 12*c* provide rear, bottom and front facing isometric views of an exemplary design for a 4×1 cluster spray applicator body for axis-symmetrically arranging the $CO_2$ composite spray nozzles and additive injection nozzle, and means for providing propellant air, $CO_2$ particles, and additives for using same. Referring to FIG. 12*a* (Rear View), the rear surface (248) of the spray applicator body (140) contains a threaded additive tube inlet port (250) for inserting and affixing an additive delivery tube, and optional grounding wire contained therein (both not shown), using for example a PEEK nut and ferrule assembly (both not shown). Moreover, the rear surface (248) of the spray applicator (140) contains four threaded inlet ports (252) arranged axis-symmetrically about the additive tube inlet port (250) for inserting and affixing $CO_2$ particle delivery tubes using for example PEEK nut and ferrule assemblies (all not shown). The threaded additive inlet port (250) and four $CO_2$ particle inlet ports (252) transition to through-ported circular channels that traverse the entire length of the spray applicator body (140). Shown in FIG. 12*b*, the bottom of the spray applicator body (140) contains a threaded propellant gas inlet port (254) which is ported through all of the additive (250) and $CO_2$ particle (252) channels which simultaneously provides a common supply of pressure- and temperature-regulated propellant gas to all spray channels containing PEEK additive and $CO_2$ particle delivery tubes (all not shown). Finally, the front face (256) of the spray applicator contains a centrally-positioned threaded additive nozzle port (258) and four axis-symmetrically arranged threaded $CO_2$ spray nozzle ports (260) for affixing the exemplary $CO_2$ composite spray nozzles and additive injection spray nozzle described under FIG. 10 and FIG. 11, respectively. The spray applicator body may be constructed of virtually any material able to withstand the pressures and temperatures commonly used in a $CO_2$ composite spray application. Exemplary materials of construction include steels, aluminum, and Delrin®.

Figure 13:
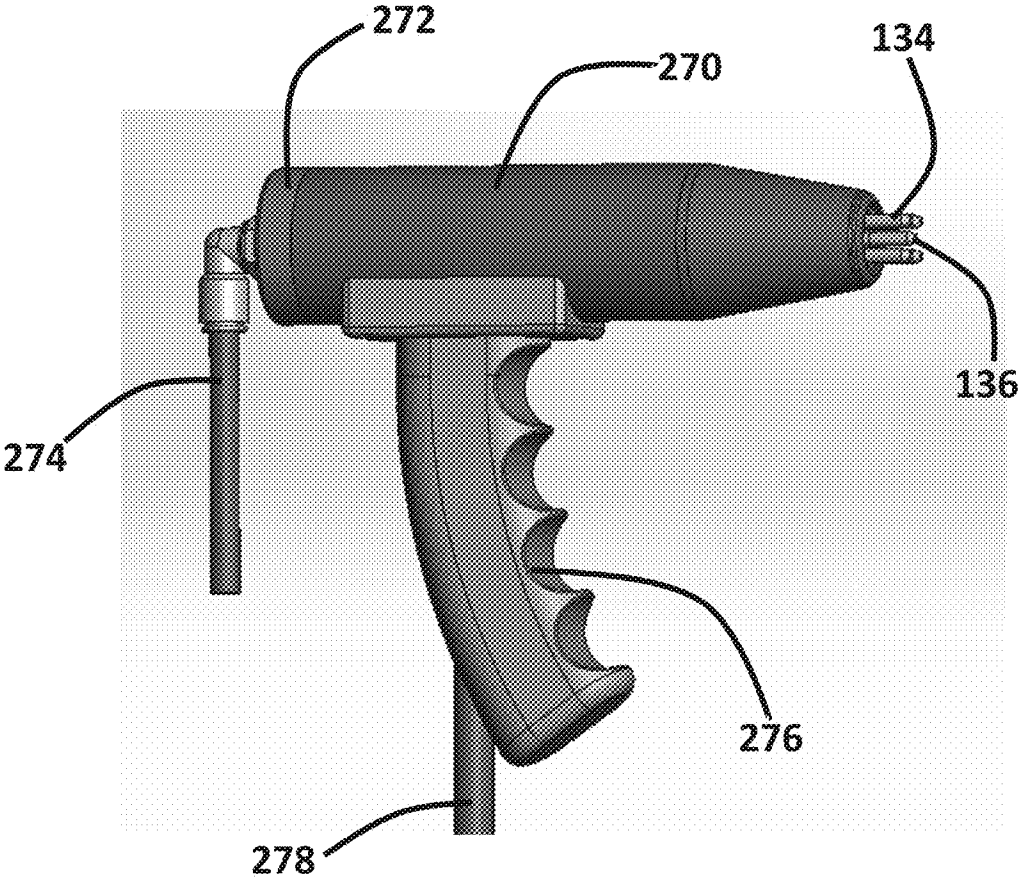
FIG. 13 is an isometric view of an exemplary 3D printed handgun assembly using the exemplary spray applicator of FIG. 12.

FIG. 13 is an isometric view of an exemplary 3D printed handgun assembly for using the present invention as a manual spray cleaning or coating application tool. Referring to FIG. 13, the exemplary spray applicator body of FIG. 12 shown with additive injection nozzle (136) and $CO_2$ composite spray nozzles (134) protruding through a cylindrical 3D printed ABS plastic shroud (270) with end-cap (272) for integrating all of the necessary PEEK additive and $CO_2$ delivery capillary tubes, all of which is contained in a delivery hose (274). The exemplary handgun assembly also has a 3D printed ABS handle (276) which is affixed to the bottom of the shroud (270) and applicator body contained therein, and contains a through-port for integrating a propellant gas supply hose (278).

Figure 14:
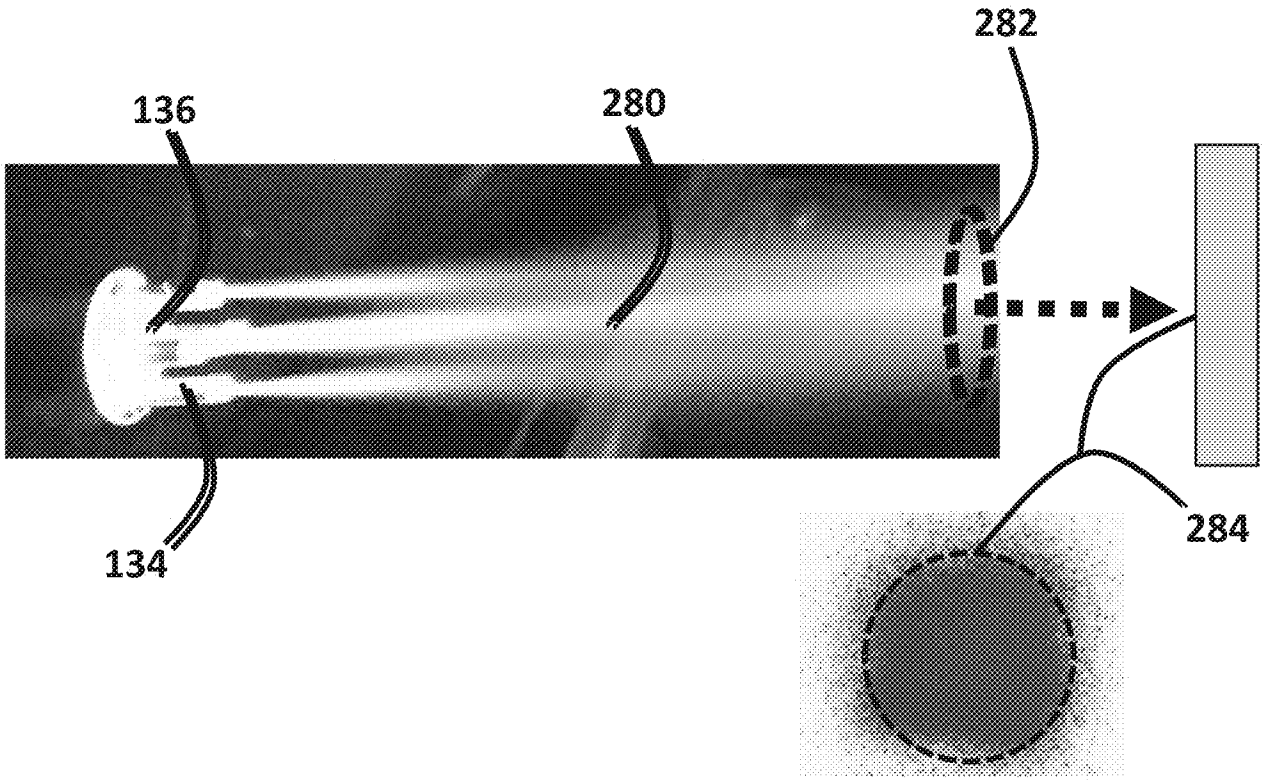
FIG. 14 is a photograph of an unheated air-$CO_2$-oil composite spray generated using a 4×1 cluster spray nozzle of the present invention.

FIG. 14 is a photograph of an unheated air-$CO_2$-oil composite spray generated using a 4×1 cluster spray nozzle of the present invention. Shown in FIG. 14, the cluster spray applicator is operated at a propellant pressure of 80 psi, propellant temperature of 20 Degrees C., an oil additive injection rate of 70 ml/hour, and a $CO_2$ injection rate of 4 lbs./hour/nozzle. As can be seen in FIG. 14, the individual sprays generated by the central additive injection nozzle (136) and four axis-symmetrical $CO_2$ composite spray nozzles (134) remain distinct for a distance of about 2 inches downstream (280). At about 4 inches downstream (282), the sprays have completely combined to form a circular and homogenous electrostatically charged air-additive-$CO_2$ particle spray with a diameter of approximately 1.2 inches. This is shown in an image produced by the impingement of the spray against a pressure test film (284), the original of which is bright red. Continuous spray operation in testing periods lasting 60 minutes (until liquid $CO_2$ cylinder supply was exhausted) using the exemplary spray test apparatus shown in FIG. 14 produced no visible icing, clogging, and oil additive accumulation on any of the $CO_2$ composite spray nozzles and additive injection nozzle.

Figure 15:
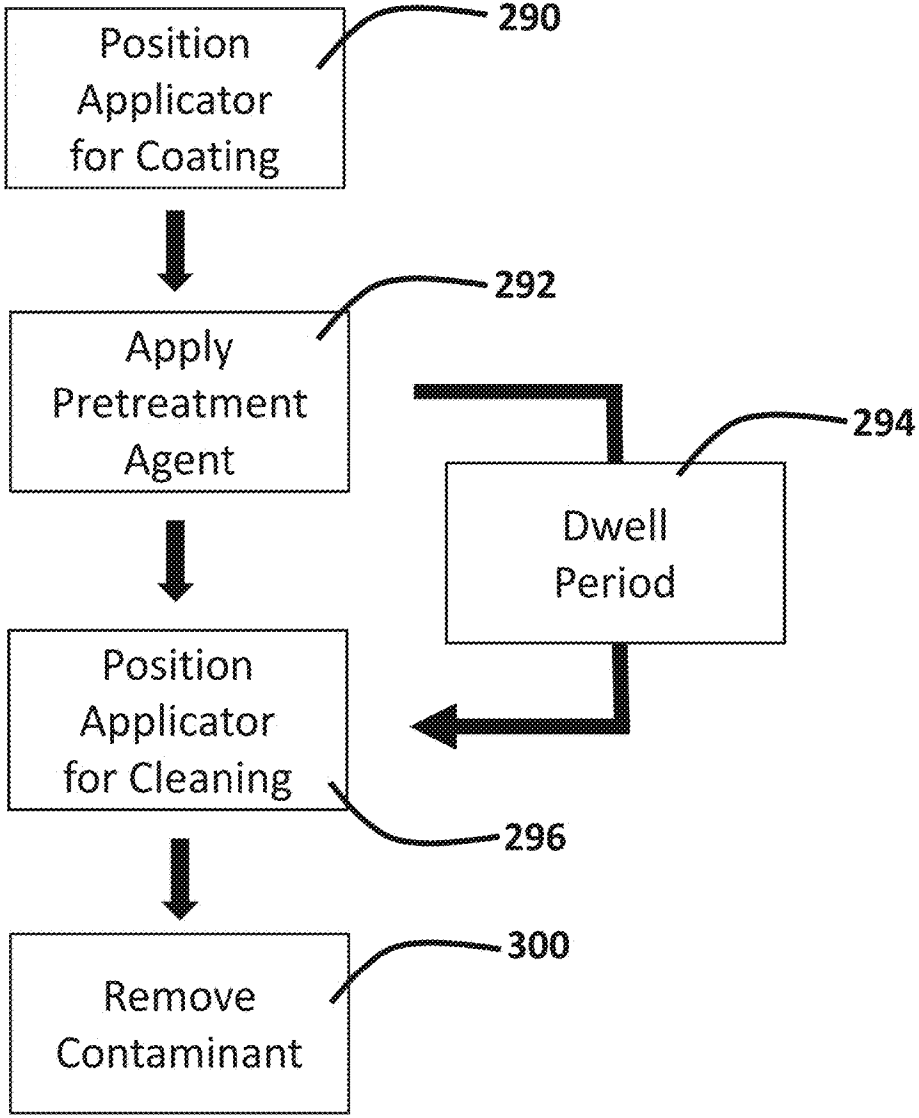
FIG. 15 is an exemplary surface pretreatment and cleaning process using the present invention.

FIG. 15 is an exemplary surface pretreatment and cleaning process using the present invention. In certain cleaning applications surface contamination can be very difficult to remove, for example following hole drilling titanium, aluminum, and carbon fiber reinforced polymer (CFRP), and stack-ups of same. Conventional hole drilling processes utilize a water-oil emulsion (i.e., coolant). This type of coolant leaves a very tacky surface residue comprising a thin film of oil, water, and surfactant. The present invention can be used to implement a novel pretreatment process that applies a uniform coat of (preferably) high boiling pretreat agent which first solubilizes (or otherwise denatures) the complex surface contaminant prior to or simultaneously during spray cleaning with a $CO_2$ composite spray.

In a first step (290) of the pretreat-clean process, the cluster spray applicator is positioned to distance from the substrate to be treated of between 6 and 18 inches, whereupon an exemplary eco-friendly, human-safe, and high boiling pretreat additive composition comprising 90% (v:v) volatile methyl siloxane (VMS) and 10% (v:v) 1-hexanol is applied (292) to the contaminated surface to form a uniform and thin film which penetrates and denatures (or detackifies) the complex surface contaminant. Exemplary cluster spray parameter ranges for the pretreatment step comprise the following:

$CO_2$ Injection Rate: 2-4 lbs./hour/nozzle
Additive Injection Rate: 10-200 ml/hour
Propellant Temperature: 20-40 Degrees C.
Propellant Pressure: 30-50 psi This pretreat coating process step is accomplished by positioning the $CO_2$ composite spray applicator of the present invention away from the contaminated surface to a distance where the $CO_2$ particle spray is useful for forming and delivering a passive electrostatic composite spray pretreatment coating, but not useful for imposing a surface impingement or cleaning effect so as not to remove the deposited coating. For example, at a distance of about 6 inches (15 cm) or more, the cluster spray applicator of the present invention is very useful for pre-coating a surface because most of the $CO_2$ particles have sublimated by this point or lack the size and velocity needed to produce an appreciable cleaning (removal) effect. Moreover, $CO_2$ injection pressure (i.e., $CO_2$ particle density), propellant pressure, and propellant temperature may be decreased as needed to facilitate the formation and maintenance of a uniform pretreatment coating.

Following the surface pre-coating step (292), and optionally following a dwell period (294) of between 3 and 600 seconds or more for the surface pretreatment agent to fully penetrate and denature the surface contaminant layer, pretreatment additive injection is stopped and the $CO_2$ composite spray applicator of the present invention is repositioned (296) towards the substrate to a distance of between 1 to 6 inches and a spray applicator angle of between 45 and 90 degrees normal to the surface to provide a precision spray cleaning step (300) to remove the residual pretreatment agent and denatured surface contaminant. Exemplary cluster spray parameter ranges for the spray cleaning step comprise the following:

$CO_2$ Injection Rate: 2-8 lbs./hour/nozzle
Additive Injection Rate: 0 ml/hour
Propellant Temperature: 40-60 Degrees C.
Propellant Pressure: 50-120 psi Finally, this novel pretreat-clean process may be performed manually using a handheld spray applicator or automatically using a robot and end-of-arm spray applicator.

Suitable additives for use in the present invention include, for example, pure liquids and blends of same derived from hydrocarbons, alcohols, siloxanes, terpenes, and esters. In addition solid particles such as graphitic nanoparticles and paint pigments may be blended with suitable carrier solvents to form pressure-flowable or pumpable liquid suspensions. Still moreover, ozonated mixtures of liquids and suspensions may be used in the present invention. Finally, additives such as ionized gases may be used in the present invention.

The present invention is useful for surface decontamination, surface coating, and precision machining applications to provide a coating, cleaning, disinfection, cooling, pretreatment, preservation, painting, and/or lubricating function.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the title, headings, terms and phrases used herein are not intended to limit the subject matter or scope; but rather, to provide an understandable description of the invention. The invention is composed of several sub-parts that serve a portion of the total functionality of the invention independently and contribute to system level functionality when combined with other parts of the invention. The terms "CO2" and "$CO_2$" and carbon dioxide are interchangeable. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. Any element in a claim that does not explicitly state "means for" performing a specific function, or "step for" performing a specific function, is not be interpreted as a "means" or "step" clause as specified in 35 U.S.C. Sec. 112, Parag. 6. In particular, the use of "step of" in the claims herein is not intended to invoke the provisions of 35 U.S.C. Sec. 112, Parag. 6.

Incorporation of Reference: All research papers, publications, patents, and patent applications mentioned in this specification are herein incorporated by reference to the same extent as if each individual publication, patent, or patent appl. was specifically and individually indicated to be incorporated by reference.

| U.S. Patent Documents | | |
|---|---|---|
| 2,052,869 | September 1936 | Coanda |
| 2,302,289 | November 1942 | Bramston-Cook |
| 2,894,691 | July 1959 | Sedlacsik |
| 3,047,208 | July 1962 | Coanda |
| 3,117,726 | January 1964 | Schoberg |
| 3,628,737 | December 1971 | Norton |
| 3,702,519 | November 1972 | Rice et al. |
| 3,708,993 | January 1973 | Hardt et al. |
| 3,743,186 | July 1973 | Mocarski |
| 3,795,367 | March 1974 | Mocarski |
| 3,801,020 | April 1974 | Mocarski |
| 3,806,039 | April 1974 | Mocarski |
| 3,984,054 | October 1976 | Frochaux |
| 3,985,302 | October 1976 | Frochaux |
| 4,038,786 | August 1977 | Fong |
| 4,046,492 | September 1977 | Inglis |
| 4,195,780 | April 1980 | Inglis |
| 4,336,017 | June 1982 | Desty |
| 4,341,347 | July 1982 | DeVittorio |
| 4,385,728 | May 1983 | Inglis et al. |
| 4,389,820 | June 1983 | Fong et al. |
| 4,555,059 | November 1985 | Collins et al. |
| 4,703,590 | November 1987 | Westergaard |
| 4,707,951 | November 1987 | Gibot et al. |
| 4,749,125 | June 1988 | Escallon et al. |
| 4,776,515 | October 1988 | Michalchik |
| 4,801,086 | January 1989 | Noakes |
| 4,806,171 | February 1989 | Whitlock et al. |
| 5,056,720 | October 1991 | Crum et al. |
| 5,125,979 | June 1992 | Swain et al. |
| 5,170,942 | December 1992 | Spink et al. |
| 5,222,332 | June 1993 | Mains, Jr. |
| 5,312,598 | May 1994 | Kersey et al. |
| 5,402,940 | April 1995 | Haller et al. |
| 5,409,418 | April 1995 | Krone-Schmidt et al. |
| 5,591,412 | January 1997 | Jones et al. |
| 5,611,491 | March 1997 | Bowers |
| 5,704,554 | January 1998 | Cooper et al. |
| 5,725,154 | March 1998 | Jackson |
| 5,765,761 | June 1998 | Law et al. |
| 5,918,817 | July 1999 | Kanno et al. |
| 6,039,269 | March 2000 | Mandzukic |
| 6,056,213 | May 2000 | Ruta et al. |
| 6,105,886 | August 2000 | Hollstein et al. |
| 6,125,787 | October 2000 | Mochizuki |
| 6,708,903 | March 2004 | Kanno |
| 7,097,717 | August 2006 | Jung et al. |
| 7,389,941 | June 2008 | Jackson |
| 7,451,941 | November 2008 | Jackson |
| 9,352,355 | May 2016 | Jackson et al. |
| 9,221,067 | December 2015 | Jackson et al. |
| 9,227,215 | January 2016 | Jackson et al. |
| 2004/0251327 | December 2004 | Messerly et al. |
| 2006/0027679 | February 2006 | Gratteau |
| 2006/0071091 | April 2006 | Ratinik |

I claim:

1. A method for treating a surface using an apparatus for producing an electrostatically charged and homogeneous CO2 composite spray containing an additive, which comprises flowable organic and inorganic liquids and solids, for use on a substrate surface, the apparatus comprising an additive injection nozzle and an adjustable expansion tube assembly, and further comprising:

a. multiple nozzle electrodes positioned axis symmetrically about the additive injection nozzle;

b. said nozzle electrodes comprising an elongated body with a nozzle tip with a center through hole, and arising from the center through hole are multiple axis symmetrically through ports;

c. proximate to said multiple through ports are landing guides for centering and positioning the adjustable expansion tube assembly;

d. the adjustable expansion tube assembly comprises a first capillary within a second capillary;

e. the first and the second capillaries are adjustable within the center through hole;

f. the additive injection nozzle comprising a through ported and grounded additive injection nozzle body containing an additive delivery tube, and the grounded additive injection nozzle body flows air to form an air-additive aerosol;

whereby CO2 particles are flowed through the adjustable expansion tube assembly to create an electrostatic charge, which is shunted to the landing guides to electrostatically charge the nozzle electrodes, and the CO2 particles then mix with air to form air-CO2 aerosol;

the electrostatically charged nozzle electrodes and the air-CO2 aerosol passively charge the air-additive aerosol;

the air-additive aerosol and the air-CO2 aerosol combine away from the nozzles to form the electrostatically charged air-additive-CO2 aerosol, which is projected at the substrate surface, whereby the CO2 particles and the additive interact to form the electrostatically charged and homogeneous CO2 composite spray containing an additive mixture in the space between the nozzles and the substrate surface; and the electrostatically charged and homogeneous CO2 composite spray containing an additive is projected at the substrate surface, comprising the steps:

a. positioning the apparatus at a first position away from the substrate surface;

b. coating the substrate surface with the electrostatically charged and homogeneous CO2 composite spray containing the additive;

c. stopping the coating of the substrate surface with the electrostatically charged and homogeneous CO2 composite spray containing the additive;

d. positioning the apparatus to a second position; and e. removing the additive from substrate surface by applying the electrostatically charged and homogeneous CO2 composite spray without the additive.

2. The method of claim 1 wherein the first position is between 6 and 18 inches from the substrate surface.

3. The method of claim 1 wherein a soak period of between 1 and 600 seconds follows the application of the electrostatically charged and homogeneous CO2 composite spray containing the additive at the first position.

4. The method of claim 1 wherein the second position is between 0.5 and 6 inches from the substrate surface.

5. The method of claim 1 wherein said substrate surface is a manufactured surface.

* * * * *